US007438432B2

(12) United States Patent
Yaphe et al.

(10) Patent No.: US 7,438,432 B2
(45) **Date of Patent: *Oct. 21, 2008**

(54) LINEAR FIXTURE ASSEMBLY

(75) Inventors: Howard Yaphe, Ville St-Laurent (CA); Pascal Toupin, Cornwall (CA); Robert Katz, Montreal (CA); Sylvain Duchesne, Bromont (CA)

(73) Assignee: Canlyte, Inc., Lachine, Quebec (CA)

( * ) Notice: Subject to any disclaimer, the term of this patent is extended or adjusted under 35 U.S.C. 154(b) by 130 days.

This patent is subject to a terminal disclaimer.

(21) Appl. No.: 11/363,340

(22) Filed: Feb. 27, 2006

(65) Prior Publication Data

US 2006/0146546 A1 Jul. 6, 2006

Related U.S. Application Data

(63) Continuation of application No. 10/898,813, filed on Jul. 26, 2004, now Pat. No. 7,055,982, which is a continuation of application No. 09/965,263, filed on Sep. 27, 2001, now Pat. No. 6,769,784, said application No. 11/363,340 is a continuation of application No. 10/689,191, filed on Oct. 20, 2003, now abandoned, which is a continuation-in-part of application No. 09/964,978, filed on Sep. 27, 2001, now Pat. No. 6,634,772.

(30) Foreign Application Priority Data

Sep. 28, 2000 (CA) ..... 2321343
Sep. 29, 2000 (CA) ..... 2321344

(51) Int. Cl.
*F21S 8/06* (2006.01)

(52) U.S. Cl. ..... 362/147; 362/219

(58) Field of Classification Search ..... 362/147, 362/217, 219, 225, 240, 368, 374, 375, 408, 362/404, 437
See application file for complete search history.

(56) References Cited

U.S. PATENT DOCUMENTS 3,299,264 A * 1/1967 Lipscomb ..... 439/226
4,726,781 A * 2/1988 Bernhart et al. ..... 439/228
6,530,674 B2 * 3/2003 Grierson et al. ..... 362/219

* cited by examiner

*Primary Examiner*—Hargobind S Sawhney
(74) *Attorney, Agent, or Firm*—John F. Salazar; Middleton Reutlinger

(57) ABSTRACT

A linear fixture for suspension from an overhead structure has a light weight and has electrical connectors capable of making easy plug electrical connections for power and network connection communications. The linear fixture is an elongated housing having a bottom wall, an elongated housing top wall and an elongated slot extending longitudinally along the elongated housing top wall. The housing is manufactured from an extrusion of aluminum thereby reducing the weight of the housing. The housing includes two or more housing supports having bottom and top surface portions respectively, conforming in shape to the housing bottom top walls. The bottom of top portions of the supports are adapted to engage or slide fit into the bottom and top walls so as to mate with the walls and provide support to the elongated housing bottom and top walls. The housing supports act to provide additional structural support for the top and bottom walls of the linear housing. The housing supports maintain the housing bottom and top walls in fixed relationship from each other. The housing supports are further adapted to be suspended from the overhead structure so as to support through the housing supports the elongated linear housing from the overhead structure. Preferably, the housing support comprises a one-piece plastic material, which reduces the weight of the fixture. The housing supports are adapted to receiving in mating relation an electrical plug whose terminals face outwardly for quick electrical connection with adjoining fixtures or a power source.

14 Claims, 19 Drawing Sheets

LINEAR FIXTURE ASSEMBLY

RELATED APPLICATIONS

This application is a continuation of and claims priority to and benefit from U.S. Publication No. 2005/0002185A1 (herein incorporated by reference), filed on Jul. 26, 2004, currently pending, which claims priority to U.S. application Ser. No. 09/965,263, filed Sep. 27, 2001, now U.S. Pat. No. 6,769,784, which claims priority to Canadian Patent No. 2,321,344, filed Sep. 28, 2000. This application is also a continuation of and claims priority to and benefit from U.S. Publication No. 2004/0080953A1 (herein incorporated by reference), filed Oct. 20, 2003, currently pending, which is a continuation of application Ser. No. 09/964,978, filed Sep. 27, 2001, now U.S. Pat. No. 6,634,772, which claims priority to Canadian Patent No. 2,321,343, filed Sep. 28, 2000.

FIELD OF THE INVENTION

The present invention relates to suspended linear structures, and, in particular, lighting fixtures.

BACKGROUND OF THE INVENTION

Modular suspended linear fixtures are typically assembled in place by connecting and mounting individual modules. Typical linear fixtures are suspended from an overhead structure and include linear fluorescent lighting systems. Such lighting fixtures may radiate light upwardly against the ceiling or downwardly towards the work area. Imprecise interfitting of such modular lighting systems results in an unsightly and unprofessional appearance and spaces between the completed assembly through which light radiates or leaks when switched on.

Typically these assemblies are suspended at heights of 7 ft. or more from the floor. Mounted and joining prior art structures entail cumbersome, and sometimes dangerous procedures. Hence the weight of these structures is an important consideration in mounting these structures from an overhead structure.

SUMMARY OF THE INVENTION

The present invention is directed to a linear fixture for suspension from an overhead structure. In particular the present invention relates to a lighting fixture which is relatively lightweight in one aspect of the present invention and is provided with electrical connectors capable of making easy electrical connections in another aspect of the present invention.

The linear fixture of the present invention comprises an elongated housing having a bottom wall, an elongated housing top wall and an elongated slot extending longitudinally along the elongated housing top wall. The housing preferably is manufactured from an extrusion of aluminum thereby reducing the weight of the housing. The housing includes two or more housing supports having bottom and top surface portions respectively conforming in shape to the housing bottom top walls. The bottom of top surface portions of the supports are adapted to engage or slide fit into the bottom and top walls so as to mate with the walls and provide support to the elongated housing bottom and top walls. The housing supports maintain the housing bottom and top walls in fixed relationship from each other. The housing supports are further adapted to be suspended from the overhead structure so as to support, through the housing supports, the elongated linear housing from the overhead structure. Preferably, the housing support comprises a one-piece plastic material made from injection moldings that reduces the weight of the fixtures.

It should be understood that the housing supports are typically provided at each of the end portions of the elongated linear housing. However, if further support is required, then a housing support may be provided along the fixture intermediate of the ends of the fixture. In accordance with the present invention, each end portion of the housing has a peripheral edge and the supports are mounted at each end portion. The supports have a peripheral flange that overlaps and abuts against the peripheral edge to thereby limit placement of the supports into the housing and preclude leakage of light from the ends of the fixture. The peripheral flange of the support preferably has of flush outward facing surface that is adapted to abut with other supports carried by other adjoining linear fixtures.

The supports may further include a raised bridge surface extending across the elongated slot so as to provide a uniform continuous surface across the end portions of the elongated housing top wall adjacent the opposing end portions.

In preferred construction, the elongated housing bottom and top walls have a cross-sectional shape in the form of an eyelet. The elongated housing bottom walls and top walls meet at the corners of the eyelet. The slot extends along the entire length of the elongated top housing wall dividing the top wall into two spaced apart housing top wall portions.

It is also envisaged that the supports have a socket, or first connector recess, and an electrical power plug connector seated in the socket. The electrical power plug connector has an outwardly facing plug end facing outwardly of the housing for connection with power source and the electrical power plug connector has an inwardly facing end from which wires extend from the support into the housing. It is further envisaged that the supports have additional sockets and second electrical control connectors seated in the additional sockets. The second control connectors have a second plug connector facing outwardly of the housing and control signal wiring extending from the support into linear housing.

It is further envisaged that the first connector recess or socket conforms to the shape of the first electrical plug connector so that the first electrical power connector is seated in at least partially mating relationship with the first connector recess. In a preferred aspect of the present invention of the first connector recess has at least one pair of opposing support walls which engage a first plug connector to seat the first plug connector in the first connector recess. The first connector recess further includes a pair of opposing converging cantilever walls, each extending rearwardly from a respective one of the pair of opposing support walls, to clamp against the first plug connector. The cantilever walls have an unsupported end portion having in-turned hook members adapted to engage the first electrical plug connector and limit travel of the first electrical plug connector into and through the first connector recess. The supports may further comprise at least one-second connector recess extending therethrough. A second electrical control pug connector is seated in the second connector recess. The second connector plug has a front face having connection terminals facing outward of the housing for connection with the control source. The second connector plug has a rear face with the electrical control wiring extending therefrom and into the housing.

In accordance with one aspect of the present invention, a linear fixture is provided for suspension from an overhead structure. The fixture comprises an elongated linear housing having at least an elongated housing bottom wall, an elongated housing top wall, and an elongated slot longitudinally extending along the elongated housing top wall. The fixture comprises a plurality of housing supports mounted within the linear housing having bottom and top surface portions respectively conforming in shape to the housing bottom and top walls. The bottom and top surface portions of the supports respectively engage in mating slide fit relationship the housing bottom and top walls to support the elongated housing bottom and top walls in fixed spaced relation to each other. The supports are adapted for suspension from an overhead structure to support the elongated linear housing from the overhead structure.

In accordance with another aspect of the present invention, a linear fixture provides suspension from an overhead structure where the fixture comprises an elongated linear housing having at least an elongated bottom wall and opposing first and second end portions. The fixture comprises first and second supports mounted respectively to first and second end portions of the housing. The first and second supports are adapted for suspension from an overhead structure to support the elongated linear housing from the overhead structure. Each of the first and second supports has a first connector recess extending therethrough. The fixture comprises a first electrical power plug connector seated in the first connector recess. The first plug connector has a front face having connection terminals facing outwardly of the housing for connection with a power source, and the first plug connector has a rear face with electrical wiring extending from the first plug connector through the support and into the linear housing.

BRIEF DESCRIPTION OF THE DRAWINGS

The invention will be better understood and its advantages will become more apparent to those skilled in the art by reference to the following drawings in conjunction with the accompanying specification in which.

DETAILED DESCRIPTION OF PREFERRED EMBODIMENTS

Figure 1:
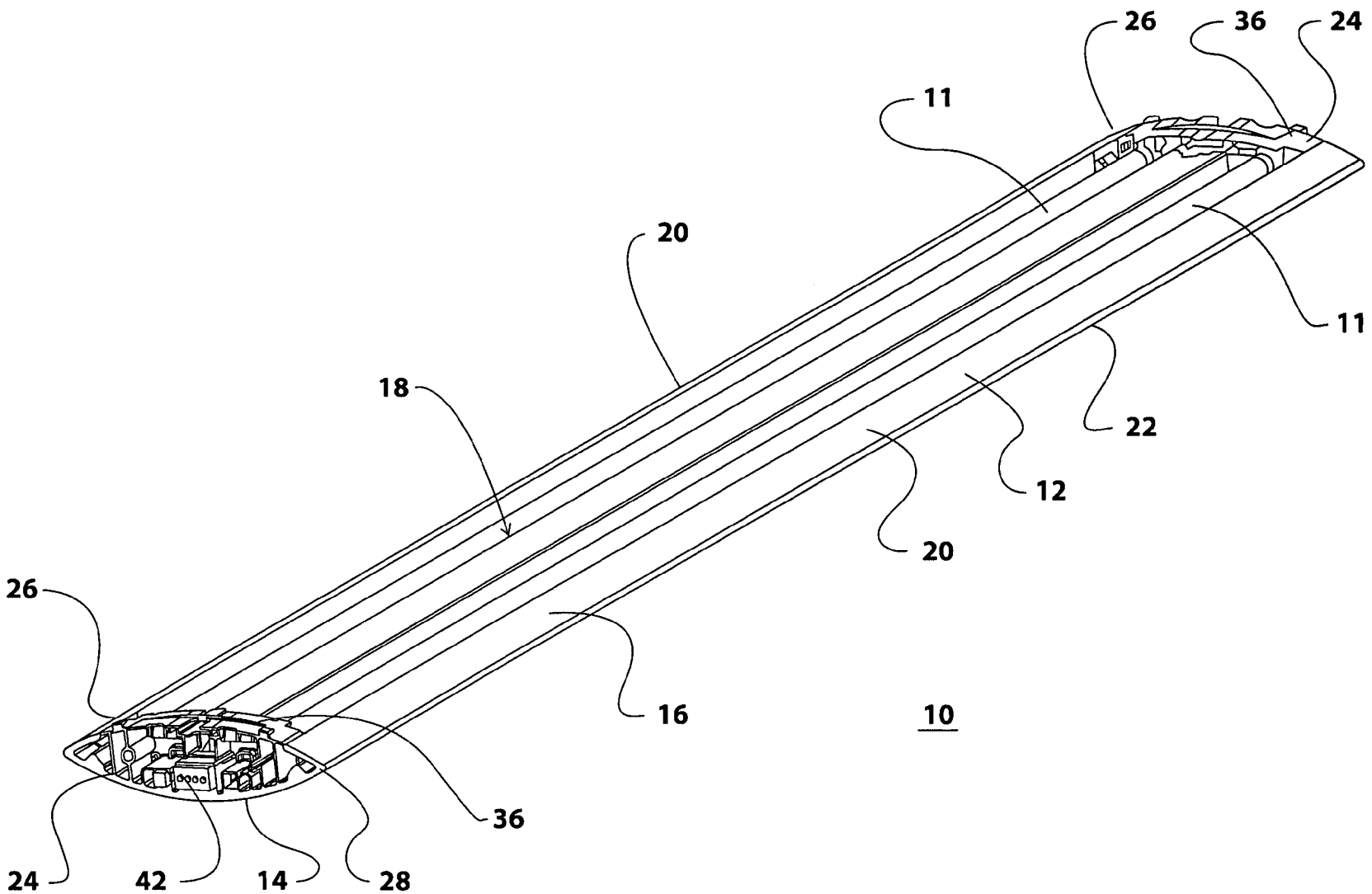
FIG. 1 is a perspective view of a linear lighting fixture of the preferred embodiment.
Figure 2:
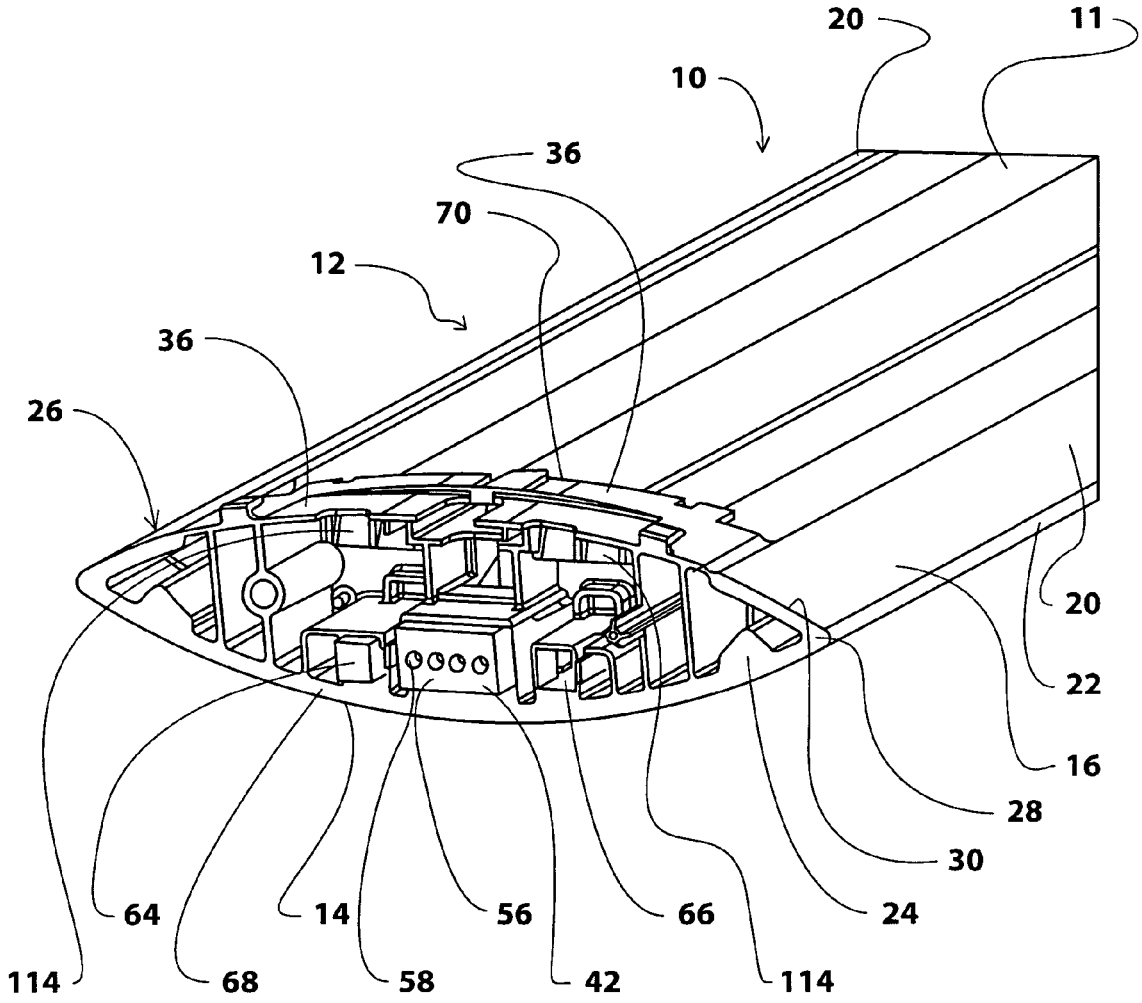
FIG. 2 is an enlarged partial end view of the linear lighting fixture of FIG. 1.

Referring to FIGS. 1 and 2, there is shown a linear lighting fixture 10 for suspension from an overhead structure. The linear lighting fixture 10 has fluorescent lamps 11 for the purposes of illuminating commercial, office, or home space. The fixture 10 has an elongated linear housing 12 that includes a bottom wall 14 and a top wall 16. The top wall 16 has an elongated slot 18 extending longitudinally along the top wall 16 of the housing 12. The elongated slot 18 extends the entire length of the lighting fixture 10 to divide the top wall 16 into two top wall surface portions 20. The housing 12 comprises an extruded aluminum material and is formed at with a corner 22 between the top wall 16 and bottom wall 14.

The linear lighting fixture 10 further includes a one-piece or molded piece plastic housing support 24 which is shown in FIGS. 1 to 5. Alternatively, the support 24 may be formed and assembled from multiple pieces. The plastic housing supports 24 are shown mounted within the housing 12 located at opposing end portions 26 of the housing 12. It should be understood that additional linear supports may be provided along the length of the housing 12 when the housings are of length to accommodate two or more fluorescent lamps 11 mounted through suitable connections in end to end relationship within one linear housing 10. The use of the molded plastic support 24 results in a weight reduction to a fixture of less than 12 pounds. Current building codes for such a lightweight fixture do not require additional suspension.

The housing support 24 is matingly inserted into the housing 12 between the housing top wall 16 and housing bottom wall 14. The housing support 24 has a peripheral flange 28 that abuts against edge or peripheral edges 30 of the housing bottom and top walls 14, 16 at the end portions 26. The abutment of the peripheral flange 28 against the peripheral edge 30 limits the insertion of the housing support 24 into the housing 12 and precludes or limits leakage of light from the end of the fixture 10. Further, the peripheral flange 28 of the housing support 24 provides a peripheral surface, which for the most part extends around the peripheral edge 30 of the housing support 24 to provide a relatively flat surface that abuts against other flat surfaces of housing support of other adjoining linear lighting fixtures to be mounted in linear adjacent relationship with the fixture 10.

Figure 3:
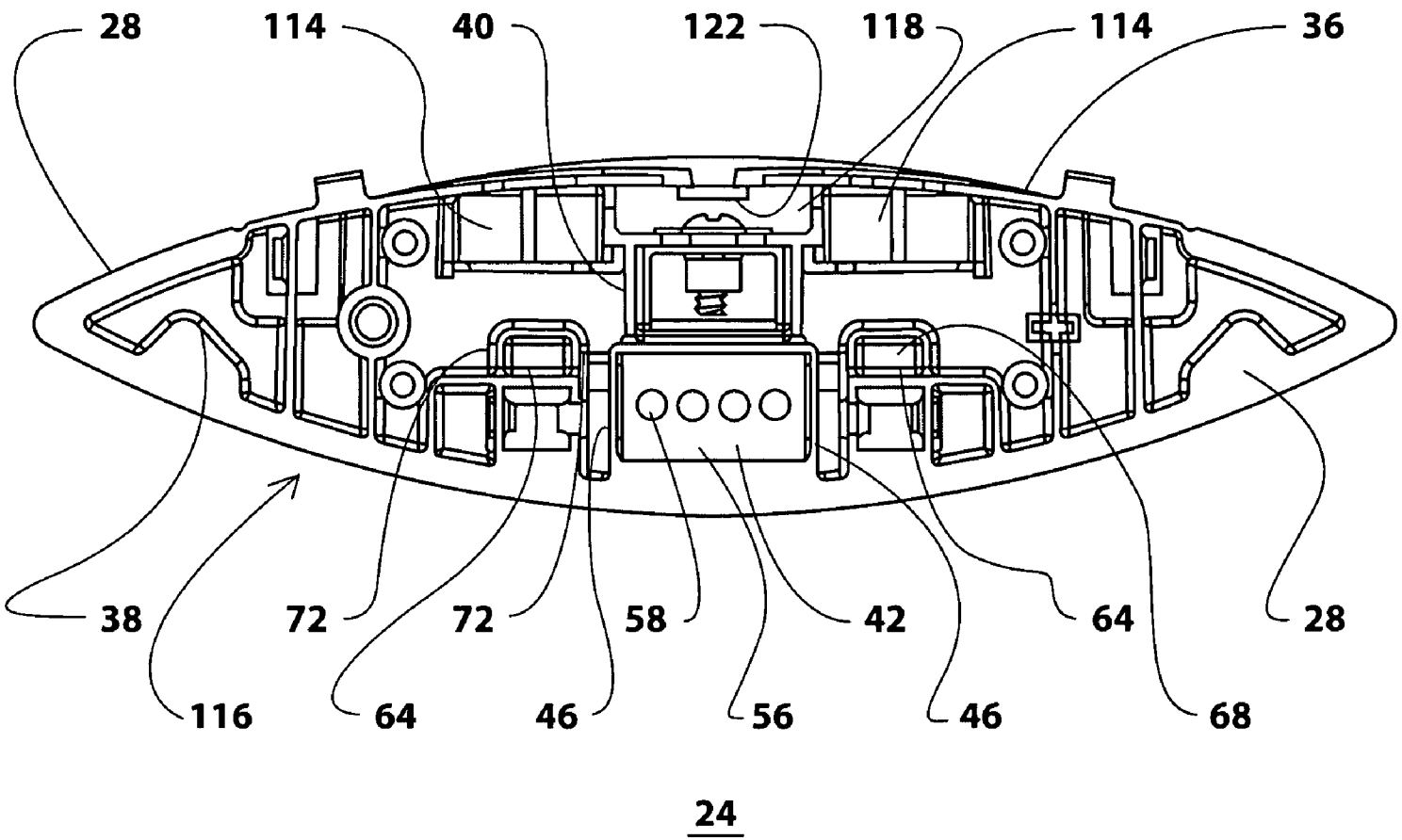
FIG. 3 is a front end view of the housing support of the linear lighting fixture.
Figure 4:
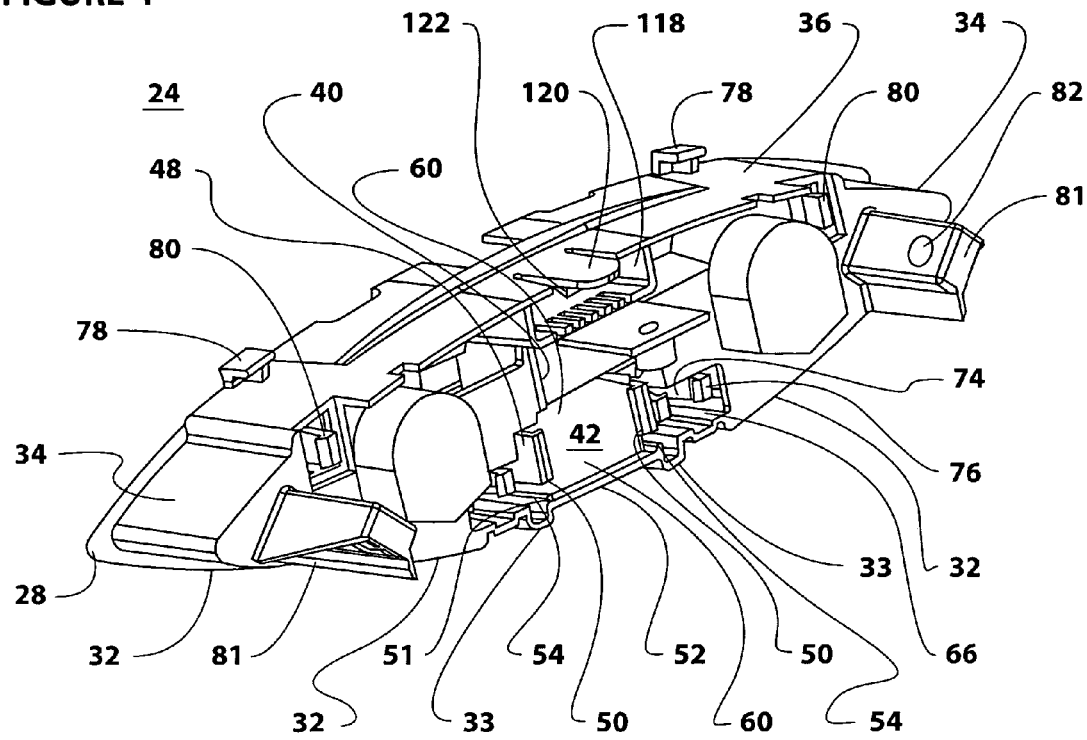
FIG. 4 is a rear end perspective view of the housing support of the linear lighting fixture.
Figure 5:
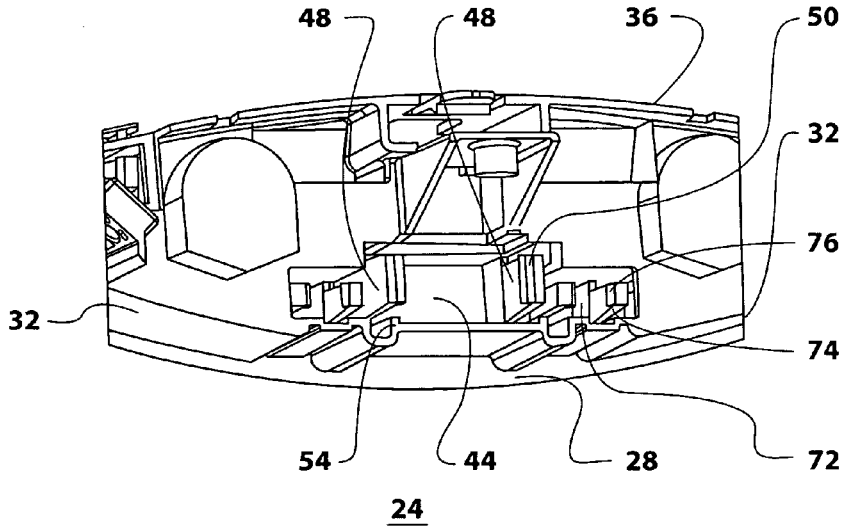
FIG. 5 is a partial rear perspective view of the housing support of the linear lighting fixture.

In FIGS. 3 and 4, the housing support 24 has bottom surface portions 32 and bottom surface ridges 33. The housing supports 24 further include top surface portions 34. The bottom surface portions 32, bottom surface ridges 33 and the top surface portions 34 conform in shape respectively to the housing bottom wall 14 and the housing top wall 16. Thus, the bottom surface portions 32 and the bottom surface ridges 33 act with the top surface portions 34 of the housing support to engage in mating slide fitting relationship the housing bottom walls or portions of these bottom walls 14 and portions of the top walls 16. The angle at which the top wall portions 20 are bent about corners 22 with respect to the bottom housing walls 14 may be chosen such that this angle is slightly less than the angle between the bottom surface portions 32 and the top surface portions 34 of the housing support 24. This will provide a tight fit for the housing support 24 when inserted into the housing 12. Further, the housing support 24 acts to support or maintain the elongated housing bottom wall 14 in a fixed spaced apart relationship from the housing top wall 16.

In the preferred embodiment shown in the drawings, the elongated housing bottom wall 14 and the elongated housing top wall 16 have a cross-sectional shape in the form of an eyelet with the elongated housing bottom wall 14 and the elongated housing top wall 16 meet at the corners 22 of the eyelet. The elongated slot 18 extends along the entire length of the elongated housing top wall 16 so as to provide two spaced apart housing top wall portions 20. Such an elongated slot 18 extending the entire length of the fixture 10 permits for significant material reduction and less material wastage in the production of the housing 12.

To provide additional strength to support the housing 12, the housing support 24 has a raised bridge surface 36 that extends transversely across the elongated slot 18 at end portion 26 of the housing 12. This raised bridge surface 36 provides a continuous or continuum in the surface across the end portions 26 between the elongated housing top wall surface portions 20.

The housing support 24 further has a series of ridges 38 and struts 40, which provide additional reinforcing strength in the housing support 24. The housing support 24 is further adapted to be suspended from an overhead structure. This feature of the housing support 24 is disclosed in more detail hereinafter.

The linear lighting fixture 10 thus far described has the advantage that it is a light weight fixture of a relatively thin gauge of aluminum sheet material extruded or formed into shape and the housing supports 24 are of molded plastic. It should be understood that the light weight linear lighting fixture 10 has advantage in that it is more easily handled by installers during installation from suspended structures which are sometimes in the order of 7 feet or more above the ground. Further, the lighter the fixture 10, the less support required from the overhead structure to support the fixture 10.

Referring again to FIGS. 1 through 5, another feature of the end support 24 is shown as a plug type electrical connector 42 housed within the support 24. The supports 24 further include a first socket or first connector recess 44 that extends through the housing support 24. From the drawings it will be seen that connector 42 is generally in the shape of a rectangular cross-section and the shape of the connector recess 44 also follows the shape 42 of the electrical connector. The electrical connector 42 is shown to be a plug type connector. In the particular drawing shown, four circular apertures are shown as female apertures for reception of a male connector. It should be understood that the connector 42 may be a male or a female connector or may be both in that it could be a coaxial type of connector. In accordance with the present invention, the type of connector used for transferring of electrical power or control signals between adjacent mounted linear lighting fixtures 10 is a plug type connector. That is for the purposes of the present invention, the connectors 42 of two adjacent linear lighting fixtures 10 are adapted to abut and matingly engage each other when the linear lighting fixtures 10 are mounted in side by side longitudinal abutting or adjoining relationship.

Because the shape of the first connector recess 44 conforms to the shape of the first electrical plug connector 42, the first electrical plug connector 42 is seated in a partially mating relationship with the first connector recess. The first connector recess 44 has a pair of opposing support walls or side support walls 46 which engage the first plug connector 42 to seat the first plug connector in the first connector recess 44. The first connector recess 44 further includes a pair of opposing converging cantilever walls 48, which further include in-turned hook members 50, which engage a rear surface of the connector 42. In FIG. 4, the housing support 24 has a bottom wall portion 52 extending between the bottom surface ridges or ribs 33 and below the connector 42. The bottom wall portion 52 has two upstanding ribs 54 that are further adapted to matingly engage or positively locate the electrical connector 42 seated within the first connector recess 44. The hook members 50 engage the first electrical plug connector 42 to positively locate the travel of the first electrical plug connector 42 into and through the first connector recess 44. The first electrical power connector 42 has a front face 56 having connection terminals 58 facing outwardly of the housing 10 and the end portions 26 of the housing 10. The plug connector 42 has a rear surface 60 with electrical wiring (not shown) extending therefrom for connection with ballast or other circuitry housed within the linear lighting fixture 10.

The electrical connector 42 is readily inserted into the end support 24 by threading the wire through the open recess or first connector recess 44 and then fitting the first electrical connector 42 in sliding mating relationship into the first connector recess 44 until the converging cantilever side walls 48 and the hook members 50 engage the connector 42. This provides for easy assembly of the electrical connector 42 within the end support 24. This also provides for the housing support or end support 24 to be readily inserted into the housing 12 in a plant facility with the wiring or wires 62 connected at the manufacturing facility to a ballast. Consequently, no additional wiring in the field is required during installation for the fixture.

The housing supports 24 located at each end portion 26 of the housing 12 have two additional second electrical control plug connectors that are seated in second connector recesses 66. The second plug connectors 64 have a front face 68 having a connection terminal facing outwardly of the housing for connection with a control source. The second plug connectors 64 have a rear face (not shown) with electrical control wiring extending from the second plug connector 64 through the housing support 24 and into the linear housing 10. The construction of the support walls of the second connector recess 66 is similar to that for the first connector recess 42. That is to say, the connector recess 66 includes second supporting opposing support walls or side walls 72 which engage the second plug connector 64 to seat the second plug connector 64 in the second connector recess 66. The second connector recess 66 further includes rearwardly extending opposing cantilevered walls 74 that converge and are provided with in-turned hook members 76 which are mounted to the cantilevered walls 74. The in-turned hook members 76 are in-turned to engage the second electric plug connector 64 and to positively locate the travel of the second electrical plug connector 64 into and through the second connector recess 66.

Figure 6:
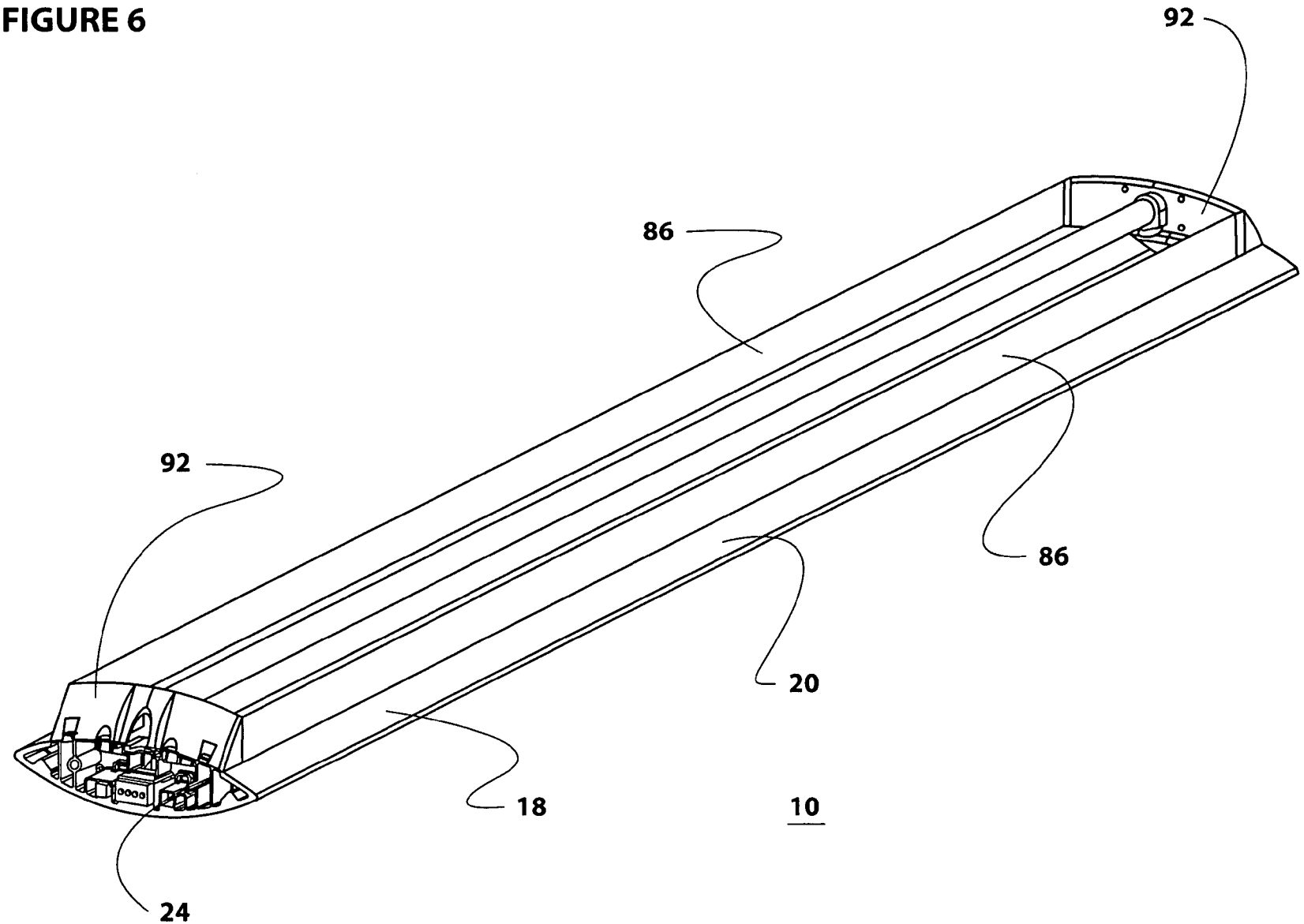
FIG. 6 is a perspective view of an alternative embodiment of the linear lighting fixture showing the use of a riser extension.
Figure 7:
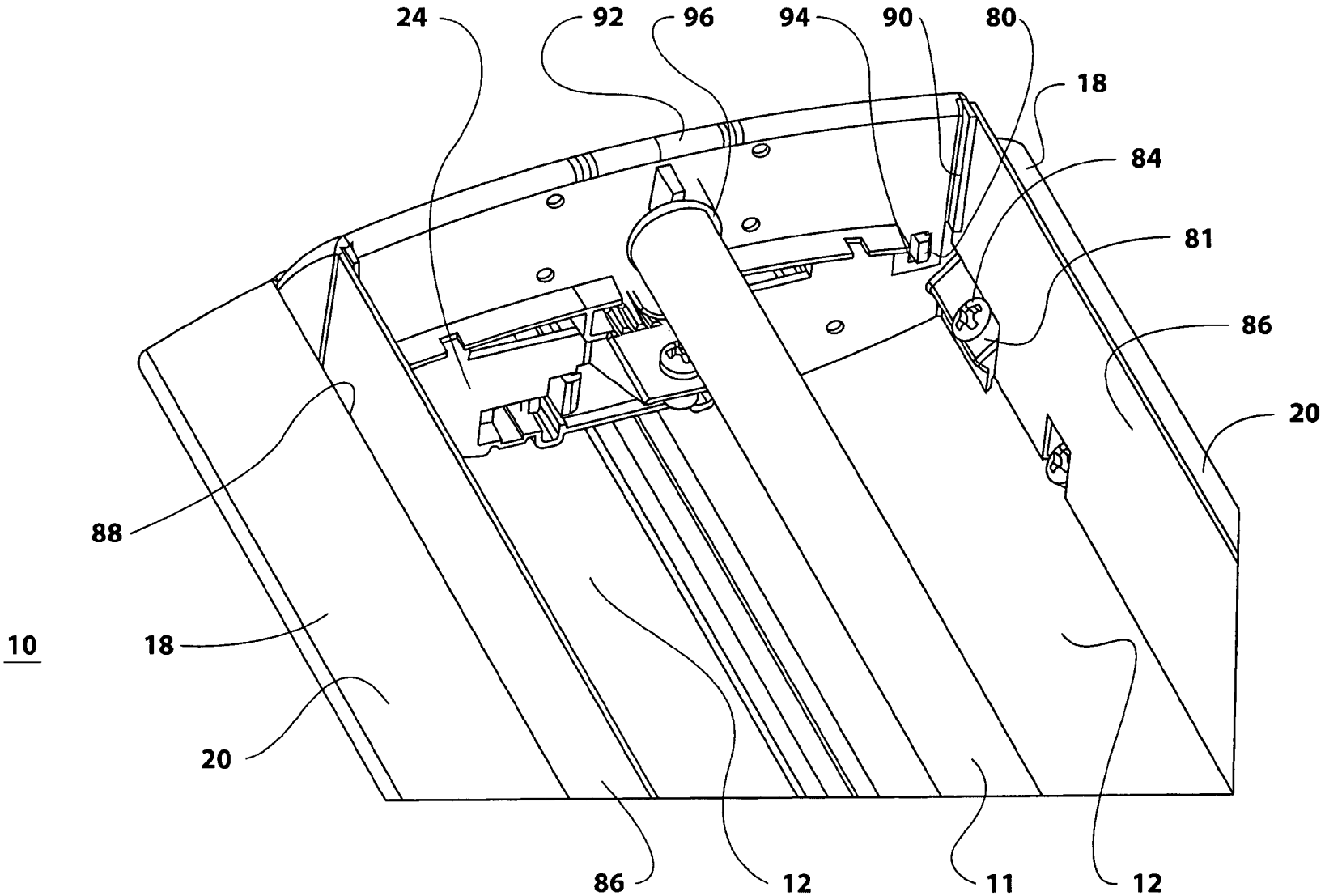
FIG. 7 is an enlarged partial perspective view of the linear lighting fixture of FIG. 6.
Figure 8:
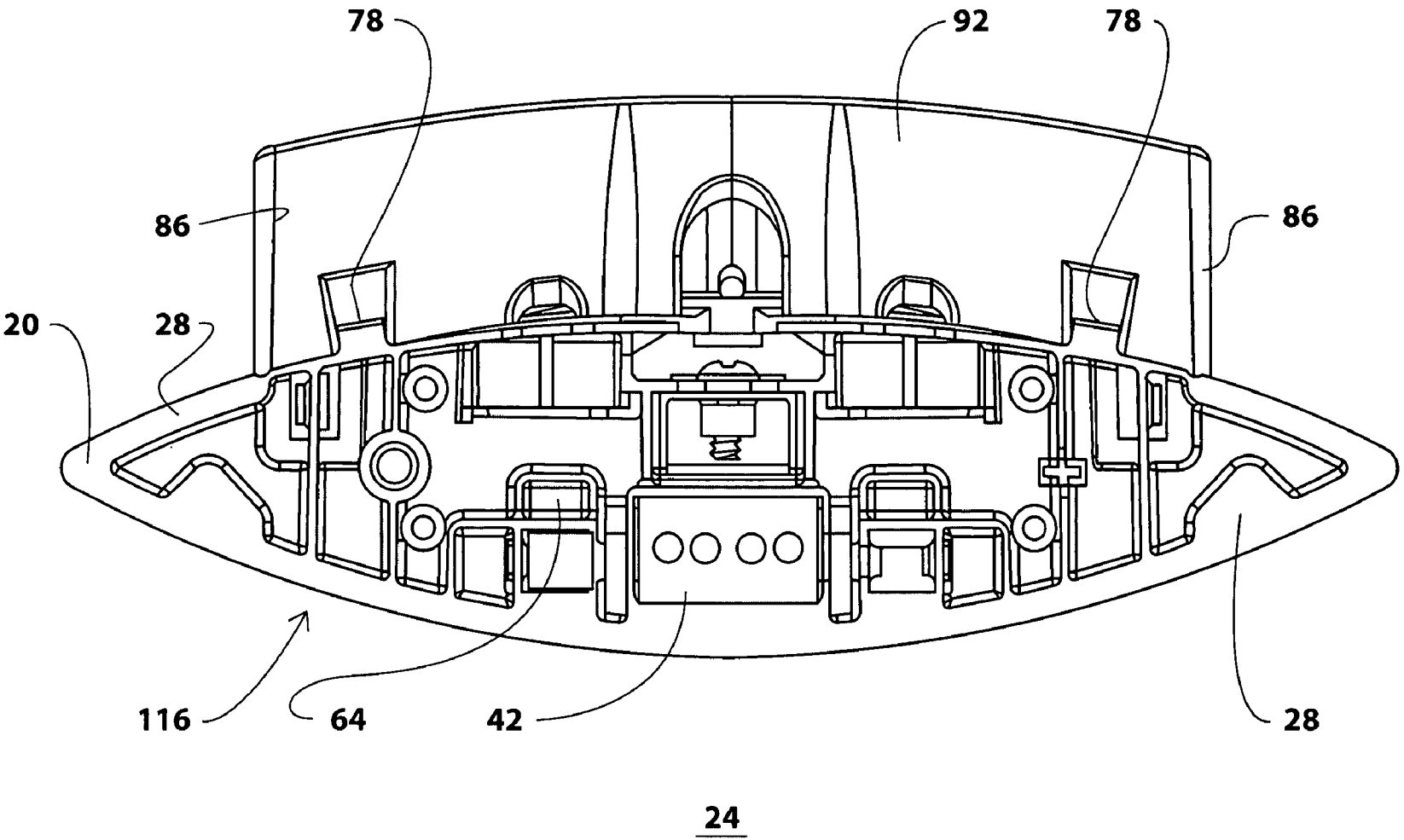
FIG. 8 is an end view of the housing support and riser of the linear lighting fixture of FIG. 6.

Referring to FIG. 4, there is shown on the bridge surface 36 of the support 24 a pair of opposing locking tabs 78 and a pair of spring tab hooks 80 below bridge surface 36. Also provided on the support 24 are rearwardly or inwardly facing ears 81 having openings 82 through which locking screws 84 (FIG. 7) pass. The purpose of the locking tabs 78, hooks 80, and ears 81 is to provide for a riser support or member 92 for supporting a lamp fixture 11 as shown in FIGS. 6, 7, and 8. In these figures, the lamp 11 is located at a raised elevation relative to the housing 10 and the housing support 24. This type of fixture is provided to have a different lighting effect. In the fixture shown in FIGS. 6 and 7, two elongated housing side walls 86 extend the length of the adjacent respective top wall portions 20. The two elongated housing side walls 86 are secured relative to the top housing wall 18 and the bottom housing wall 14 by means of locking screws 84 extending through the opening 82 and ears 81 to positively locate one side surface of the side walls 86 in force abutting relationship against the in-turned edge 88 of the housing top wall portion 20. The side walls 86 are further mounted in place in abutting relation at their end against flanges 90 which form part of a riser member 92. The riser members 92 are mounted by sliding edge portions thereof over the hook 78 and are also provided with openings 94 to hook members 80 of the housing support 24 extend. The riser member 92 is further provided with a socket 96 adapted to receive the lamp 11. This feature of being able to modify the construction of the linear lighting fixture 10 to include the riser support 92 and the additional or alternative lamp 11 allows for the manufacture of a more flexible linear lighting fixture 10.

Thus far, in the description of the preferred lighting fixture 10 of the present invention, the description has been limited to the construction of the fixture 10 itself to include a housing 12 and a housing support 24. Further modification to the housing 12 has been provided by the addition of housing side walls 86 and a riser member 92. As is stated previously, the housing support 24 may be further adapted to support the linear lighting fixture 10 from an overhead structure. The housing support 24 is also previously described to include a peripheral flange 28 which was adapted to lie flush in mating engagement or abutting relationship with another end support 24 and the linear lighting fixture 10. To explain this feature of the linear lighting fixture and in particular the housing support 24, reference is made to FIGS. 9 through 20, for which a linear lighting fixture suspension system is shown.

Referring to FIGS. 9 through 12, there is shown a suspension system 98 for suspending adjacent end portions 26 of the first linear lighting fixture 100 and a second linear lighting fixture 102 that extend generally along longitudinal axis 103. The suspension system suspends the linear lighting fixtures 100, 102 from overhead structure 108 in a manner to be hereinafter described.

Previously, reference was made to housing supports 24. For the purposes hereinafter described, these housing supports 24 are referred to as joiner supports 24. All similar features and numbers will be used for the joiner supports 24 as have been used previously for the housing supports 24. The term joiner supports 24 is used in this aspect of the present invention to further exemplify that the supports 24 have a function that goes beyond the supporting the housing of the linear lighting fixture to that of supporting adjoining linear lighting fixtures 100 and 102. The joiner supports 24 are shown as before mounted to each of the adjacent end portions 26 of the first and second linear lighting fixtures 100, 102. The joiner supports 24 have their peripheral flanges 28 shown in abutting relationship in FIG. 9. The flanges 28 are brought into abutment during the assembly of fixtures 100, 102 on the suspension system 98. The joiner supports 24 have a pair of spaced apart inclined clamping walls 114, which are shown in FIGS. 2 and 3 mounted from or suspended from the bridge surface 36 of the joiner support 24. The inclined clamping walls 114 are further shown in the cross-section of FIGS. 11 and 12. Each of the inclined clamping walls 114 is accessible from a respective end portion of the joiner support 24 which is labeled numeral 116 showing the view into the end of the joiner support 24 of FIG. 3. Each of the clamping walls 114 slopes upwardly of the longitudinal access 103 and inwardly of the respective end portion 116 or the end portion defined by the peripheral flange 28 of the joiner support 24.

The adjacent joiner supports 24 of the fixtures 100 and 102 have first adjacent alignment receiving slots 118. The alignment receiving slots 118 each have a depending finger 120 that extends rearwardly of the bridge 36 of the joiner support 24. The depending finger 120 has a transverse rib 122.

Mounted within the lighting fixtures 100 and 102 is a reflector support 124 which is located by a locating screw 126. The locating screw 126 serves another purpose, which is discussed hereinafter.

Figure 14:
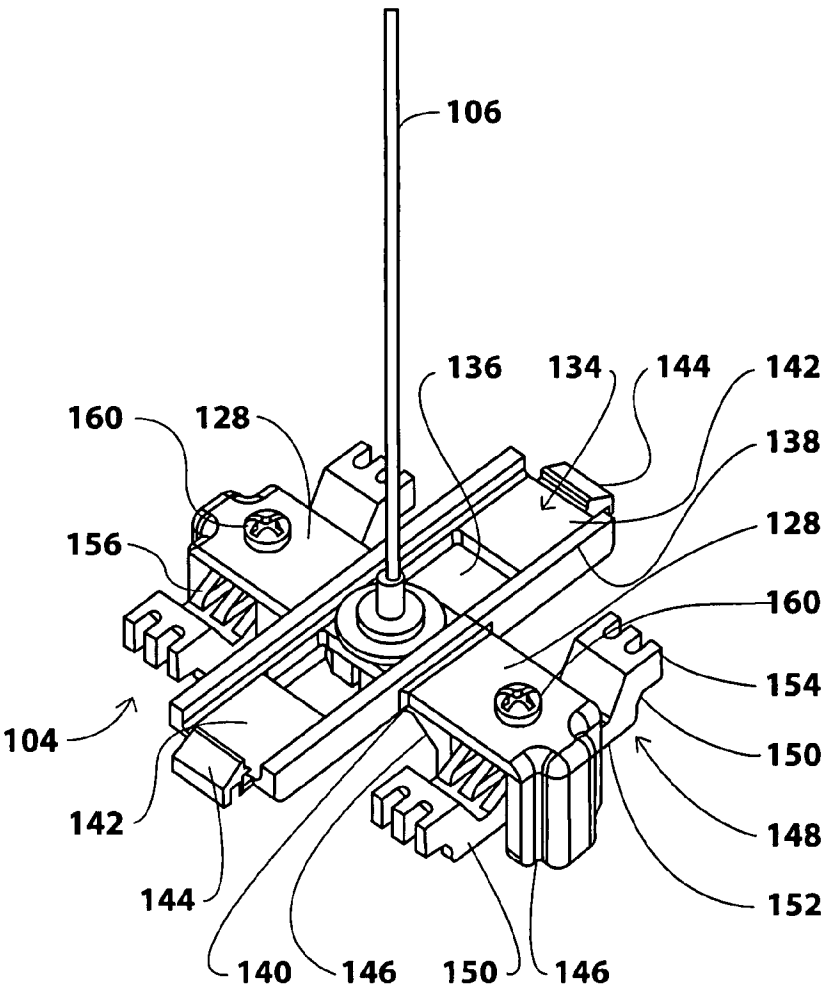
FIG. 14 is a perspective view of the hanger member of FIG. 13.
Figure 13:
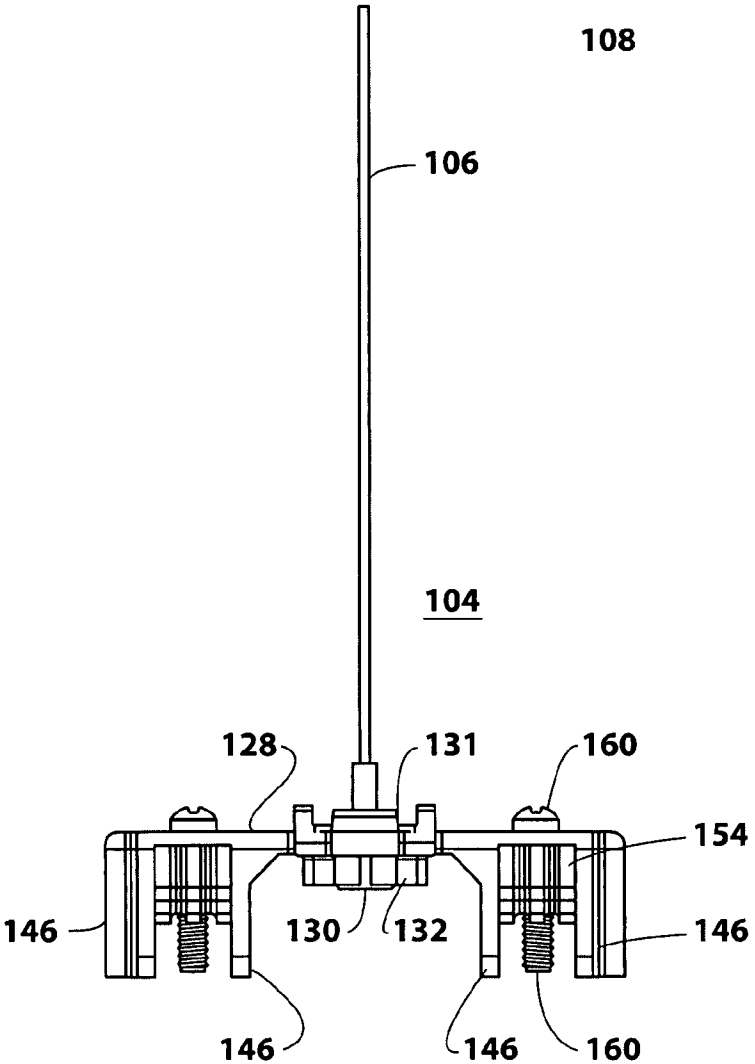
FIG. 13 is a side view of the hanger member used to suspend the linear lighting fixtures.
Figure 15:
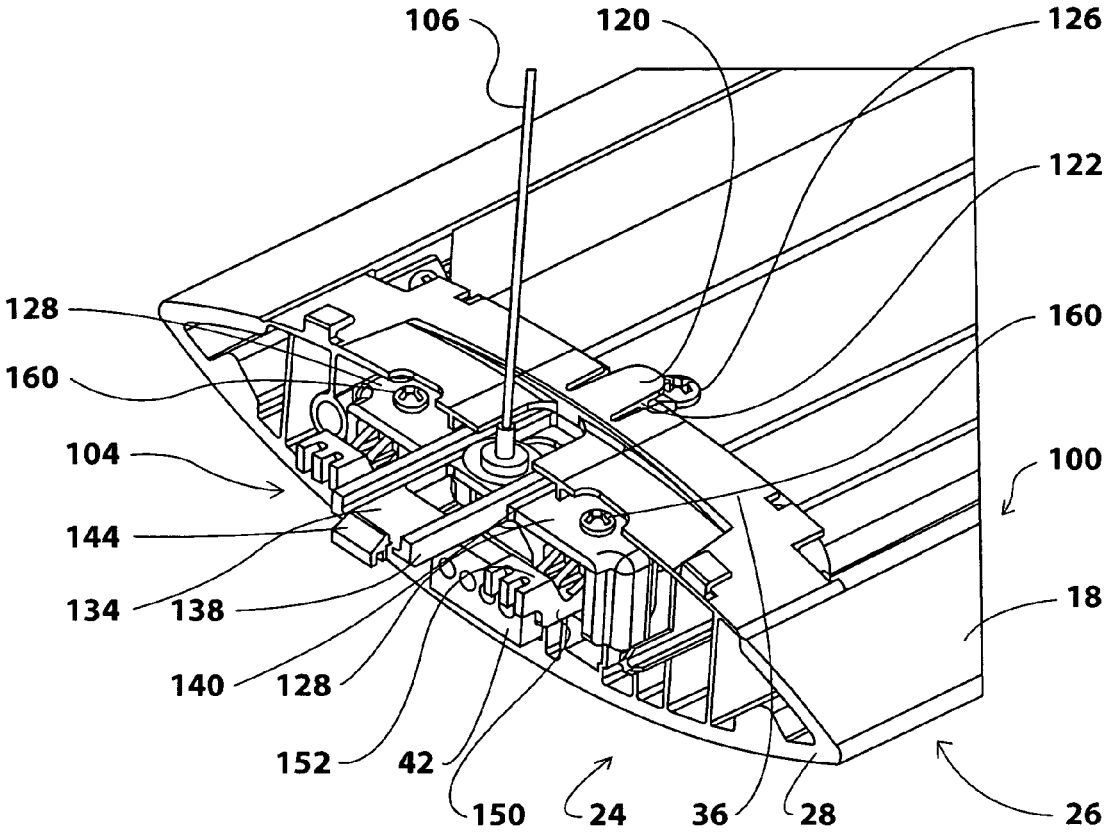
FIGS. 15 and 16 are partial perspective views showing the insertion of the hanger member in a joiner support in accordance with the connection as shown in FIG. 11.
Figure 16:
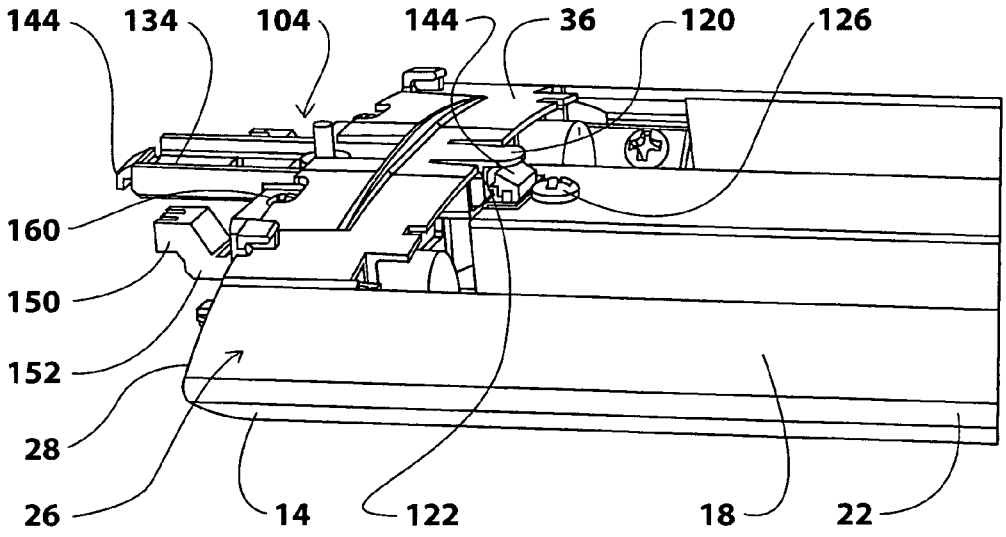
Figure 17:
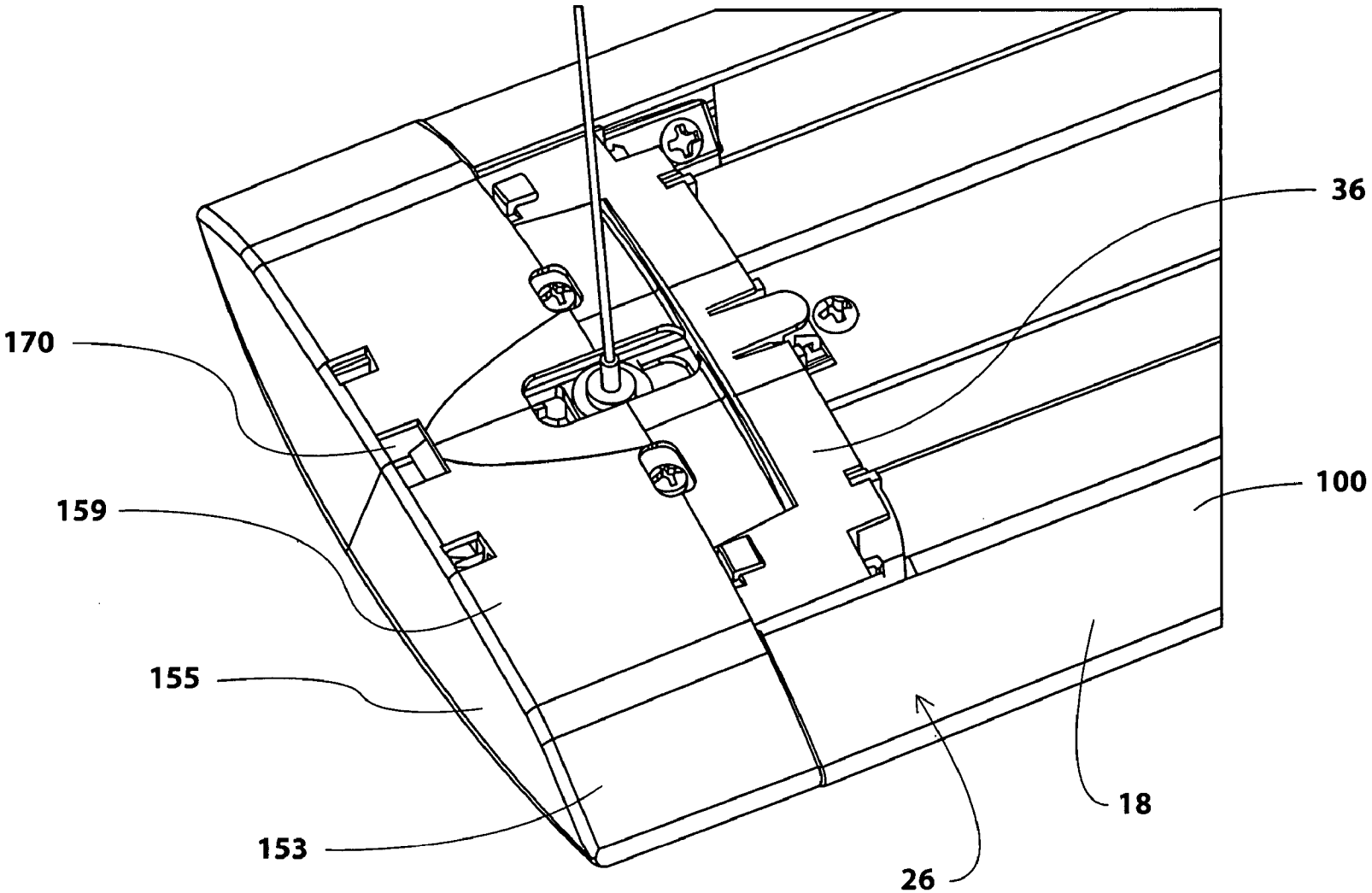
FIG. 17 is a perspective view showing the suspension of a linear lighting fixture and end cap from the preferred suspension system.
Figure 18:
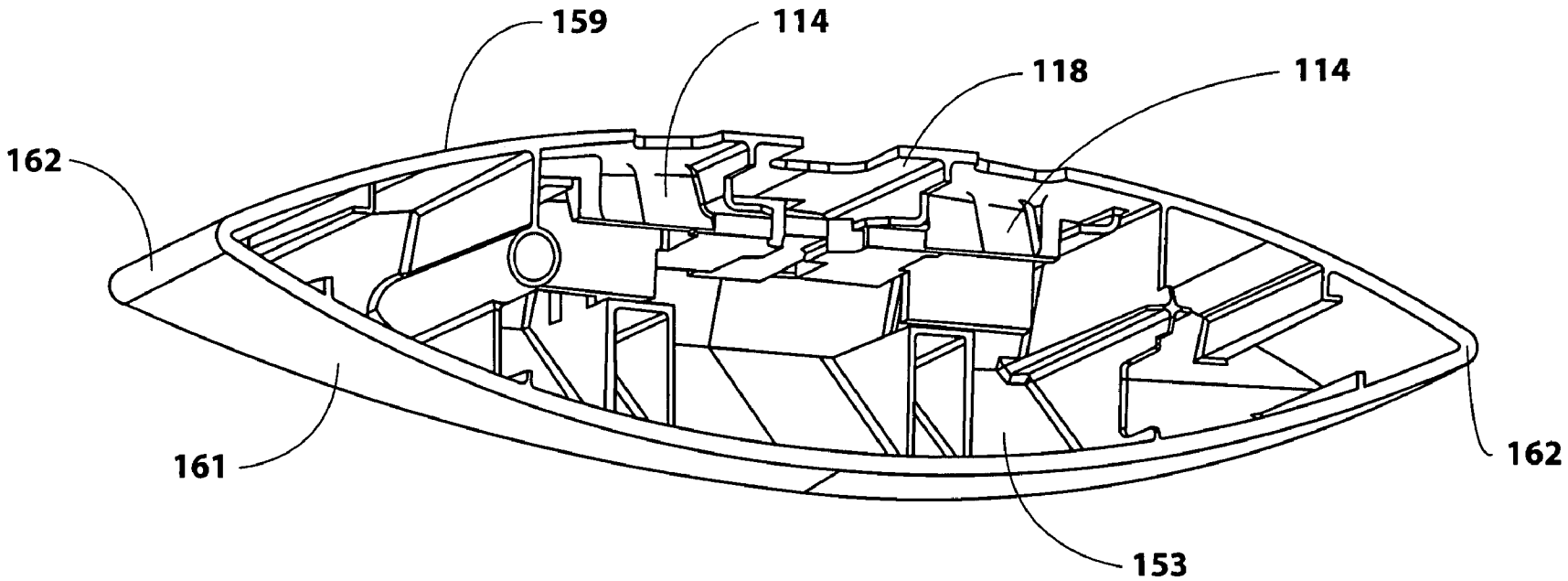
FIG. 18 is a perspective end view of the cap.
Figure 19:
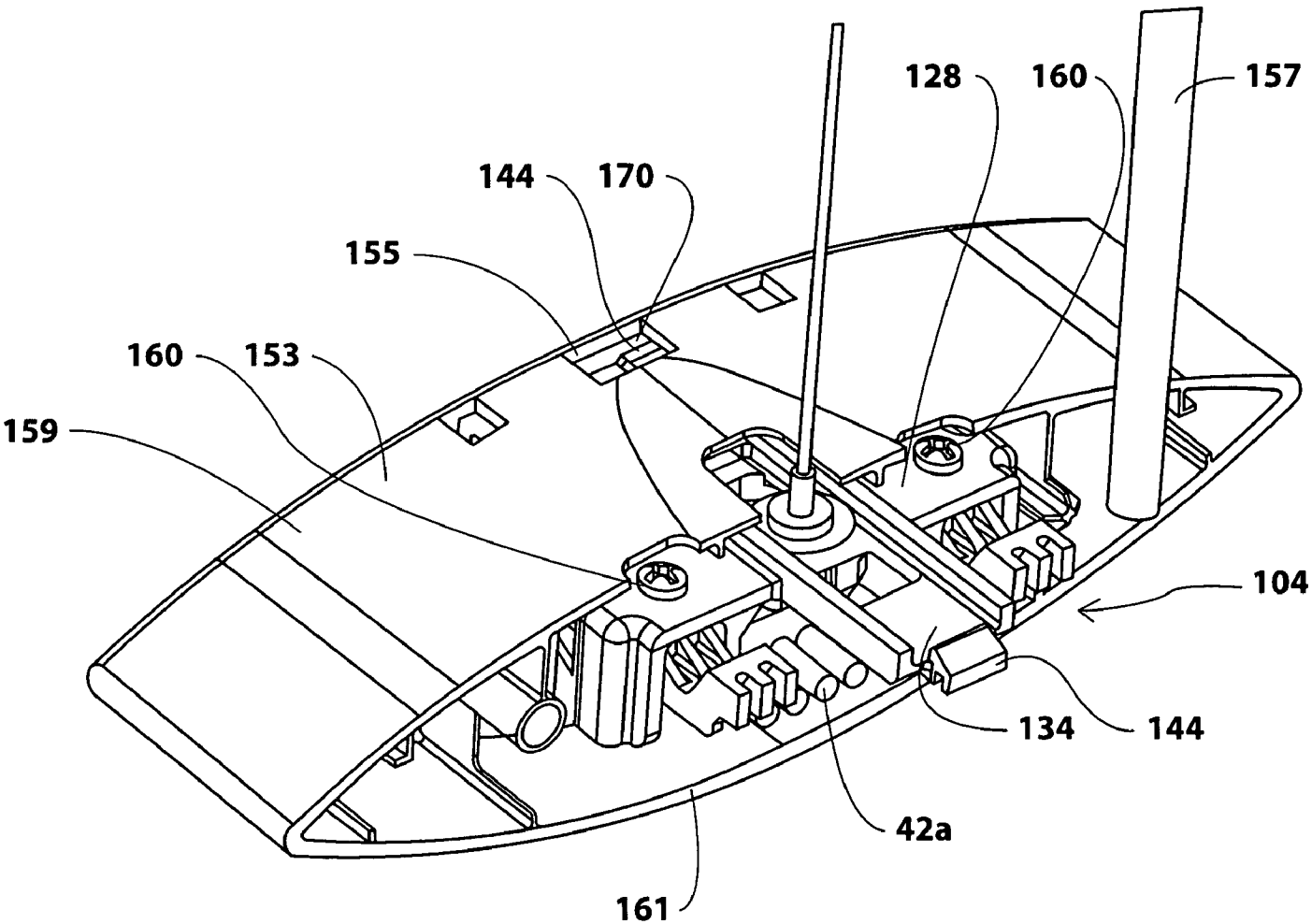
FIGS. 19 and 20 are perspective views showing the hanger member mounted in the end cap.

The suspension system further includes a hanger member generally designated 104 and shown as a component part in FIGS. 13 and 14. The hanger member 104 is suspended from the overhead structure 108 by wire 106. The purpose of the hanger member 104 is to support the first and second linear lighting fixtures 100 and 102 from the overhead structure 108.

The hanger member 104 has a bridge member 128 adapted to extend transversely of the longitudinal axis 103. The bridge member 128 has an opening 131 through which the wire 106 passes to a washer 130 mounted within a socket 132. The washer 130 mounted within socket 132 permits for relative floating of the bridge member 128 with respect to the wire 106 so that the bridge member 128 may be suspended in a plum fashion from the overhead structure 108.

The bridge member 128 has an elongate alignment member 134 which in turn has an opening 136 therein to allow for the wire 106 and washer 130 assembly to be mounted to the bridge structure 128. The elongate alignment member 134 has side walls 138 which are seated within guide walls 140 of the bridge member so as to positively locate the alignment member 134 to the bridge member 128. The alignment member 128 has a pair of opposing tongues 142. The pair of opposing tongues 142 or tongue insert portions 142 are adapted to extend along one of the adjacent alignment receiving slots 118. The tongue portions 142 are terminated in an upwardly directed resilient hook member 144. The tongue portions 142 have a width less than the width of the receiving slots 118 to permit relative lateral movement therewith.

The bridge member 128 has two downwardly depending ribs or side wall supports 146. Suspended between the ribs 146 from each side of the bridge 128 are a generally V-shaped wing member 148 having two spaced apart wings 150 and a central interconnecting member 152. The ends of the wings 150 are shown with a series of reinforcing fingers 154 and the central portions of the interconnecting member 152 are shown with a series of reinforcing ribs 156. A vertically adjustment screw 160 passes through the bridge member 128 between side supporting walls or ribs 146 to support or hold the interconnecting member 152 in a depending fashion from the bridge member 128.

Figure 9:
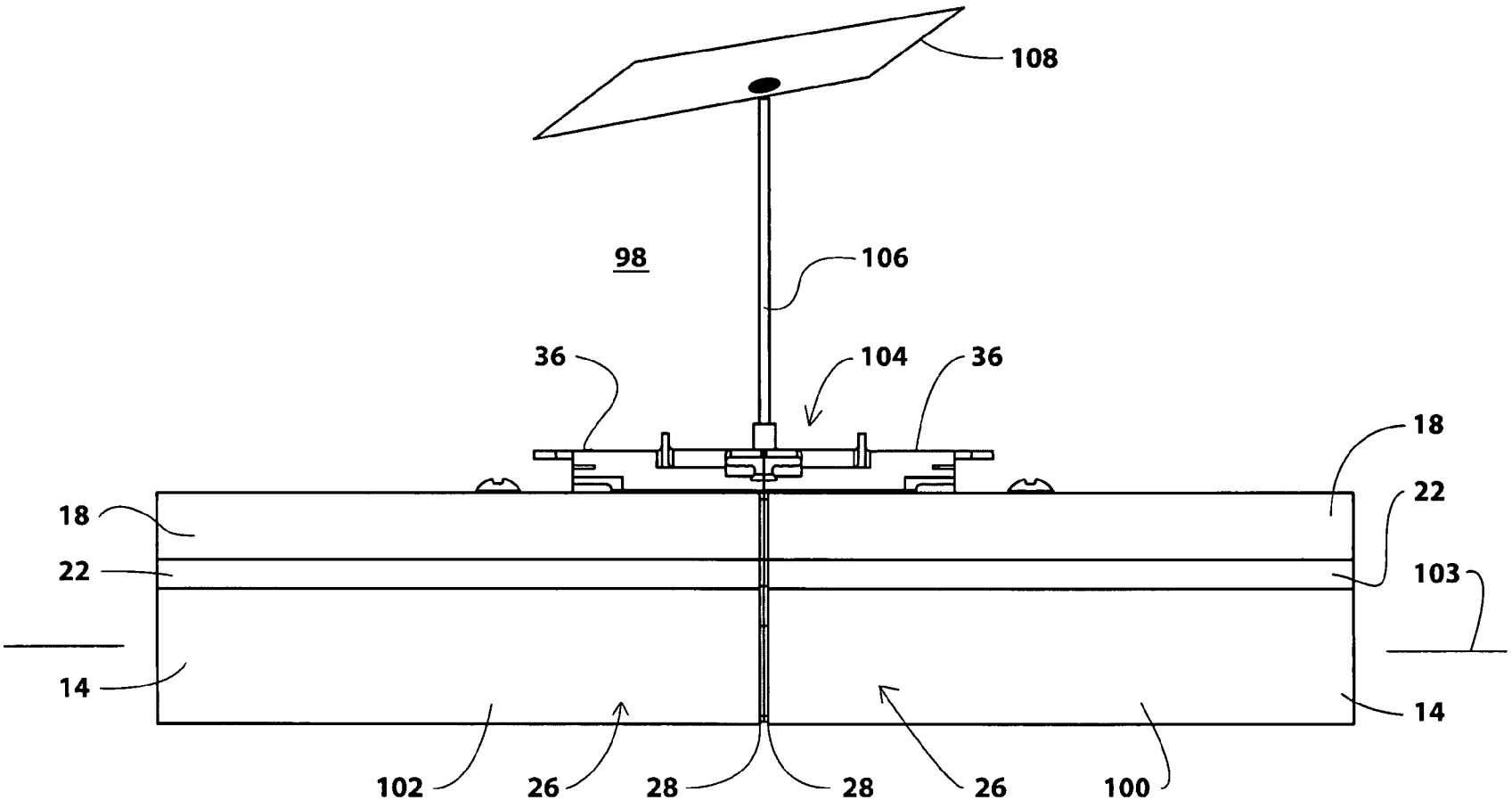
FIG. 9 is a side elevational view showing the suspension system for suspending two linear lighting fixtures from an over-head structure.

The assembly of the two linear lighting fixtures 100 and 102 as shown in FIG. 9, is described with reference to FIGS. 10 to 12.

Figure 10:
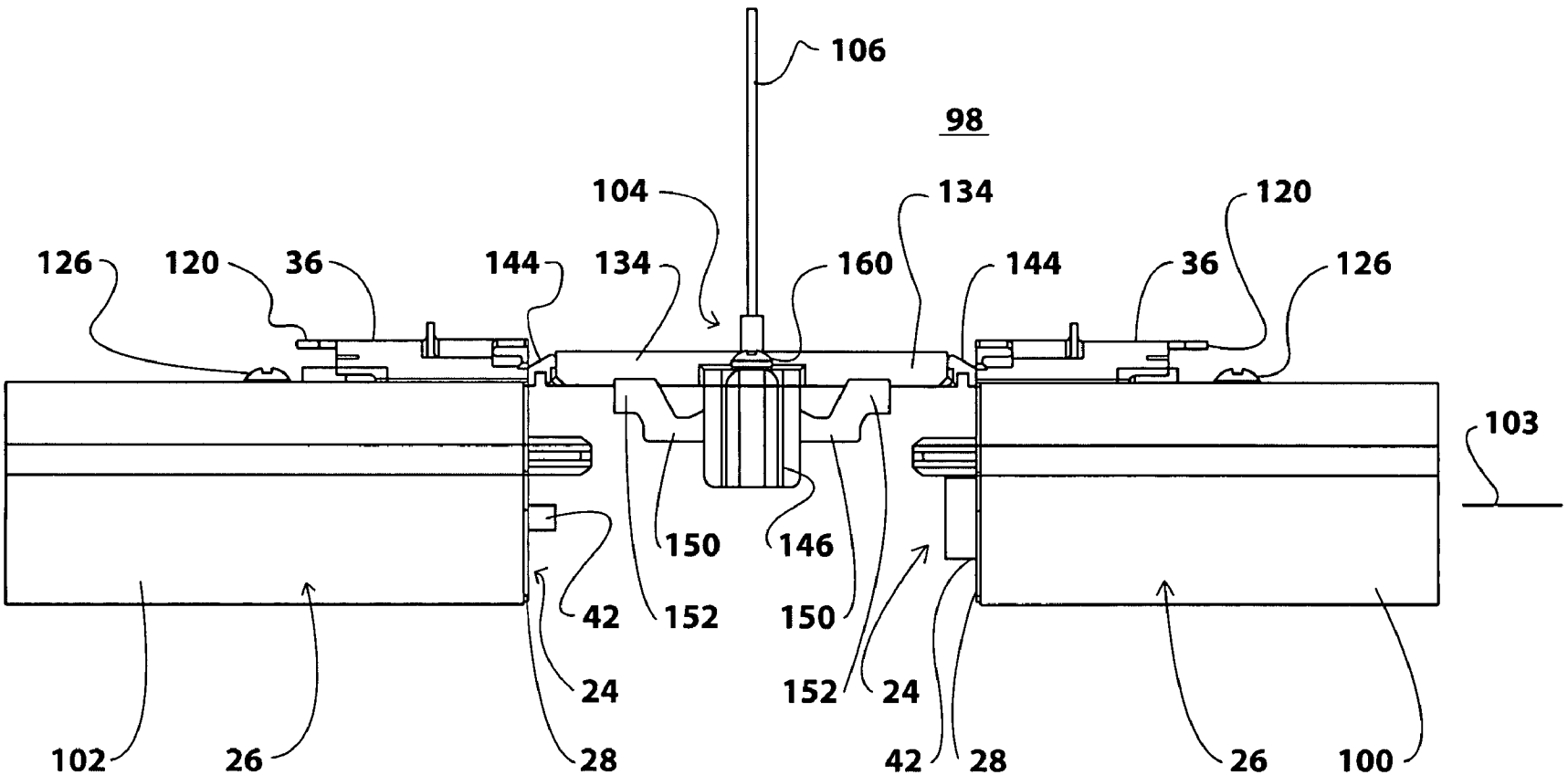
FIGS. 10 to 12 show the stages of connecting and suspending the linear lighting fixtures prior to complete assembly as shown in FIG. 9.

In FIG. 10, the hanger member 104 is suspended from the overhead structure 108 by wire 106. Next, the linear lighting fixtures 100 and 102 are positioned adjacent to the hanger member 104. It should be understood that for the purposes of this drawing, the two linear lighting fixtures are shown positioned along a longitudinal axis 103. However, in practice, one linear lighting fixture would be orientated along linear axis 103 for temporary connection to the hanger assembly 104 and then the second linear lighting fixture 102 is also temporarily connected to the hanger assembly 104 prior to secure connection. By temporary connection it is meant that the loose connection of the linear lighting fixtures 100 and 102 as shown in FIG. 11.

Figure 11:
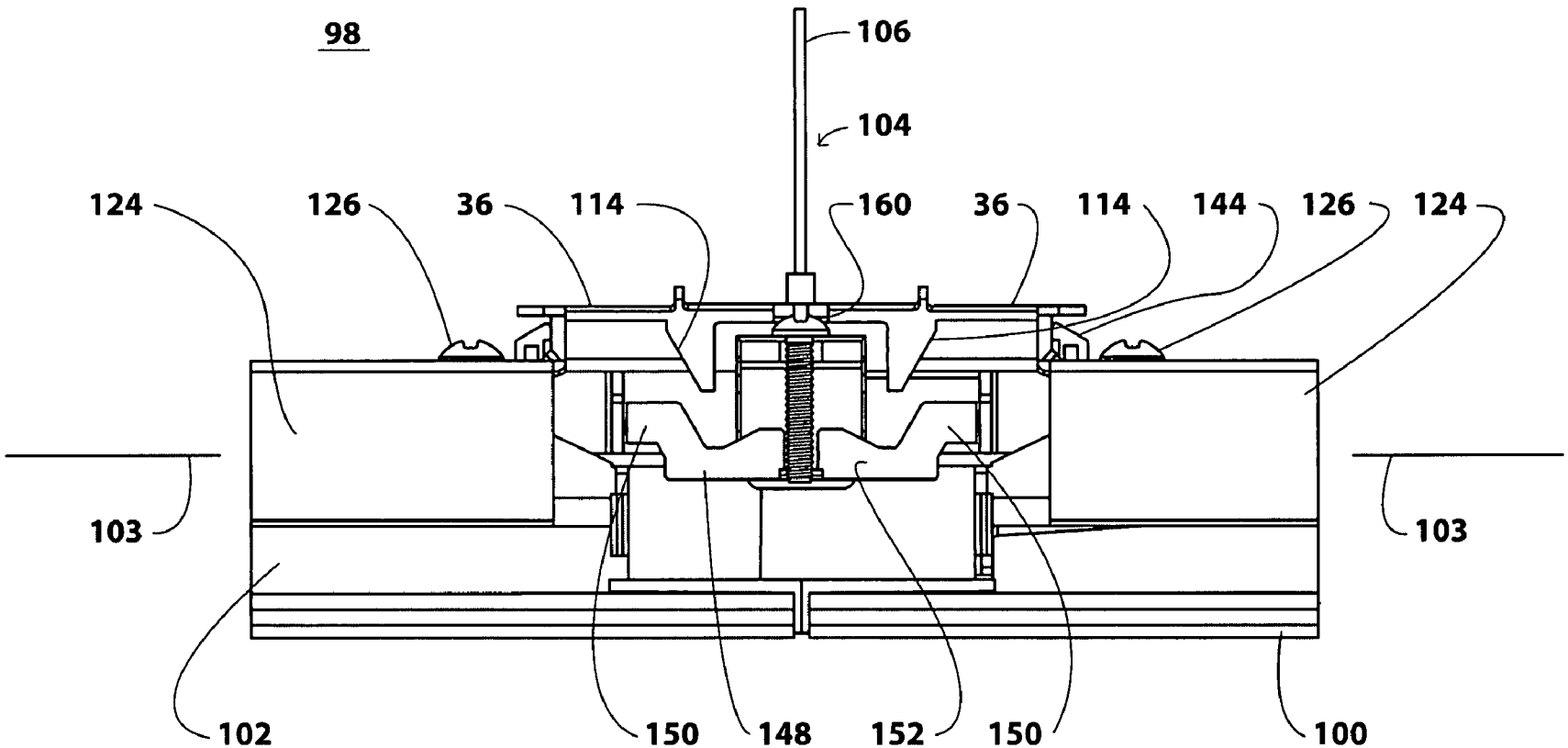
Figure 12:
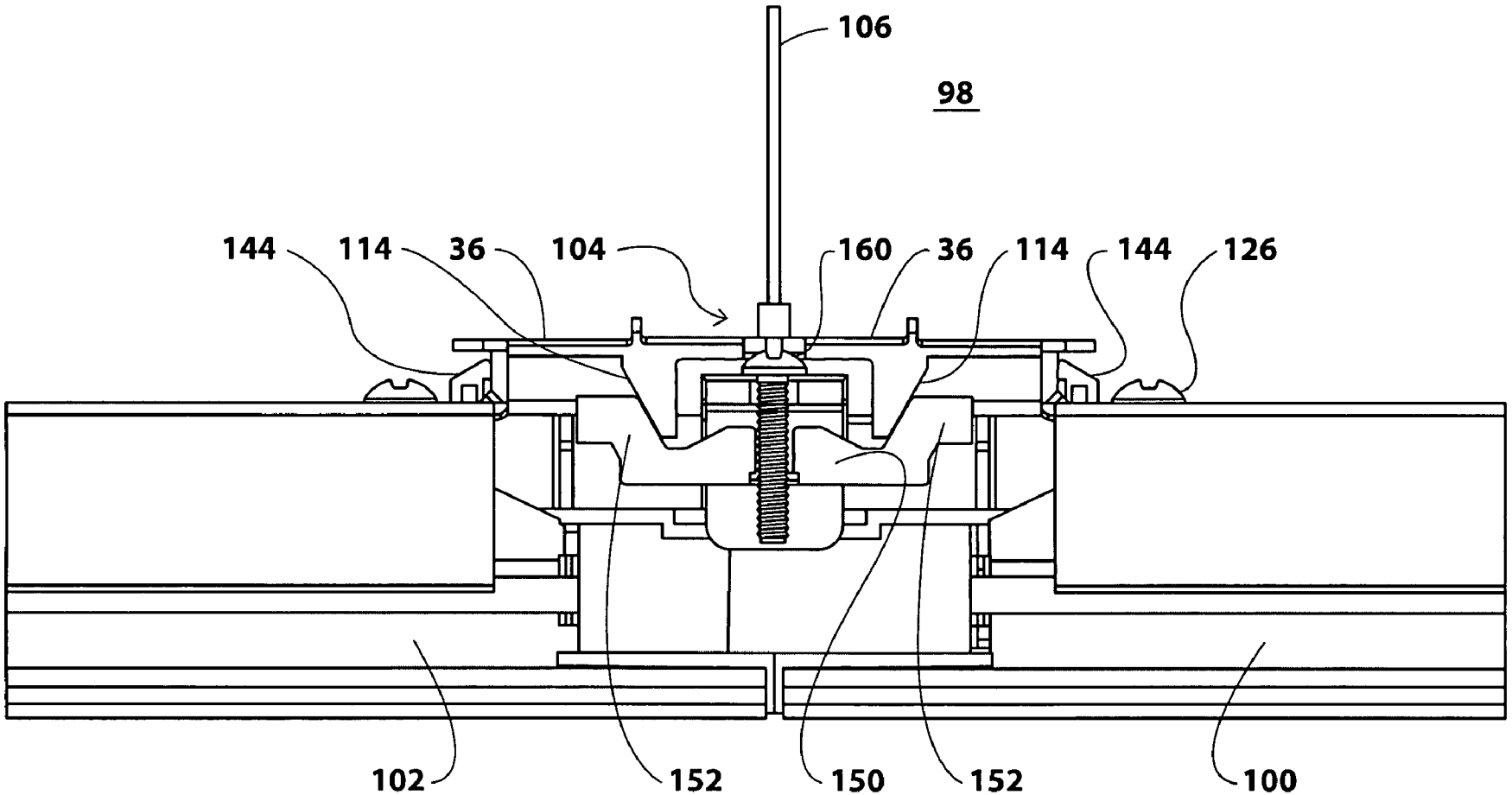

In FIG. 11, the elongate alignment member 134 has been inserted into the alignment-receiving slot 118 of the joiner support 24. The alignment member 134 has its corresponding tongue portion 142 inserted into alignment receiving slot 118 until the hook 144 passes the tongue 120 and is locked in place relative to the depending rib structure 122. Once either fixture 100 or fixture 102 is so connected, the other fixture 100 or 102 may also be so connected. It should also be noted from FIG. 11 that the wing-shaped clamping member or clamp comprising the interconnecting member 150 and the wings 152 are positioned adjacent and in loose relationship with the ramp or clamping inclined walls 114 of the joiner support 24. This permits for a loose mechanical connection of the linear lighting fixtures 100 and/or 102 relative to the hanger member 104 for relative longitudinal and lateral adjustment. Once so connected, the linear lighting fixtures 100 and 102 do not have to be physically supported by an installer. Furthermore, the assembly of the elongate support member 134 within the first alignment receiving slot 118 is a loose connection which provides for some relative movement between the linear lighting fixtures 100 and 102 and hanger number 104.

Referring to FIG. 10, the connectors 42 of each of the end portions 26 is shown with a male connector on the linear lighting fixture 102 and the female connector on the linear lighting fixture 100. These plug connections 42 are partially or temporarily made during the assembly of the hanger member 104 as shown in FIG. 11. To complete the assembly and insure a proper mechanical and electrical interconnection between the linear lighting fixtures 100 and 102, the adjustment screws 160 are rotated to draw up the interconnecting member 150 of the wing shaped clamps 152 so as to bring the wings 152 up into sliding clamping engagement with the inclined walls 114 of the joiner supports 24 as shown in FIG. 12. This tightly locks the two linear lighting fixtures 100 and 102 in abutting and adjoining relationship with the hanger member 104 whereby the peripheral flanges 28 of the joiner supports 24 abut one another. It also brings the plug connectors 42 into tight electrical contact with each other.

By providing such a system of suspension and connection between two linear lighting fixtures 100 and 102 extending along the same longitudinal access 103, it is possible to have a temporary supported connection and then have this connection firmly made or disengaged. Furthermore, the linear lighting fixtures 100 and 102 may be readily disassembled by releasing the screws 160 to drop the wing shaped clamp members 152 out of engagement with the inclined clamping walls 114 and then lifting the tab 120 so as to release it from hook 144 so that the elongate member 134 may be removed from the alignment receiving slot 118. This provides for a flexible linear lighting fixture assembly which may be readily assembled and disassembled to accommodate for different changes in lighting fixture patterns.

Figure 20:
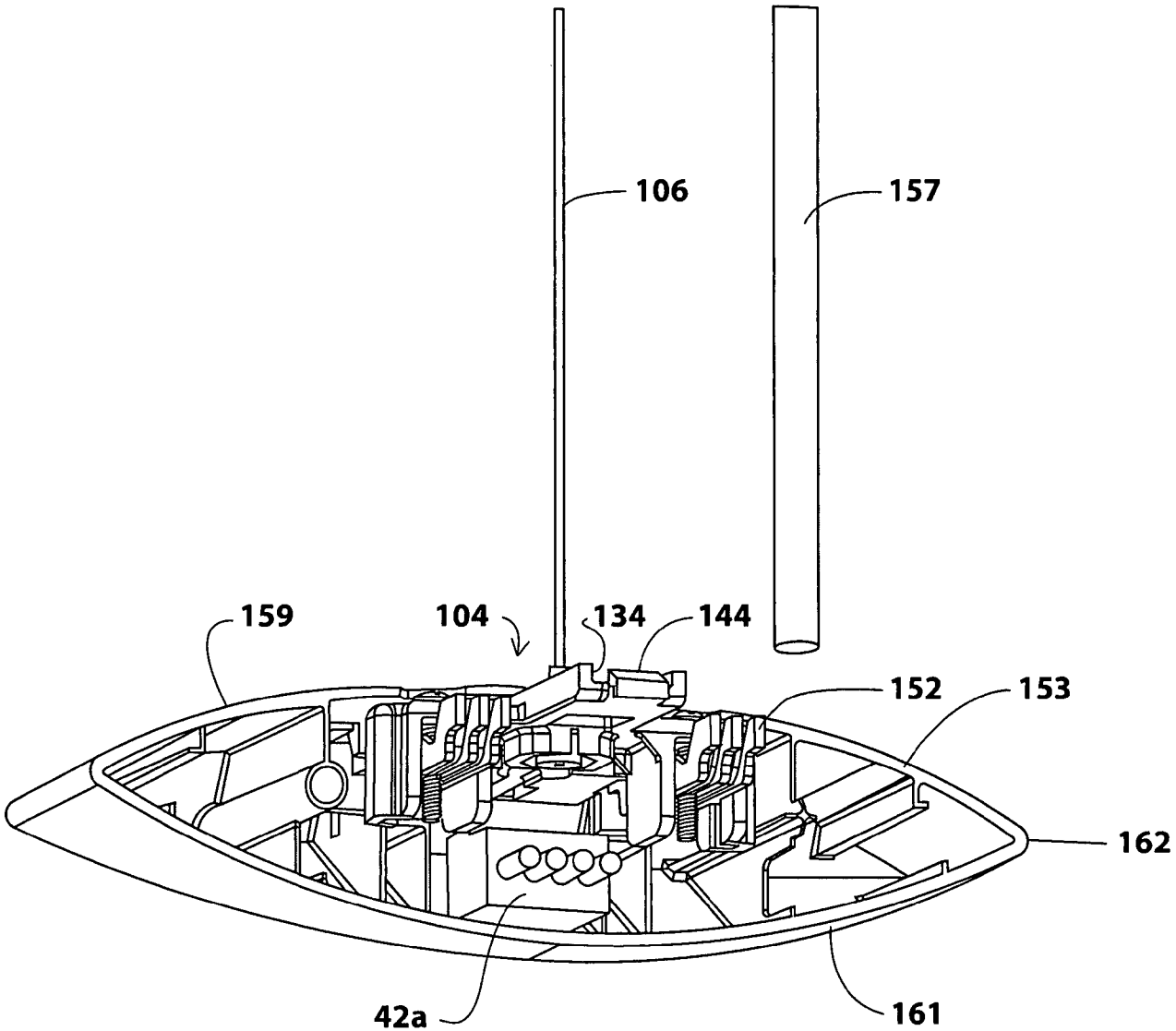

Referring to FIGS. 17 through 20, there is shown an end cap 153, which is adapted to close off the end portion 26 of the fixture 100. The end caps 153 are utilized in the present invention where the linear extension of the lighting fixtures comes to an end. The end caps 153 provide for a cosmetic and esthetically pleasing cover for the linear lighting fixture 100 while at the same time providing for a source of power 157 (FIG. 20) through opening 170 into the male plug connector 42*a* (FIG. 20).

The end cap 153 has an end wall 155, a top wall 159, a bottom wall 161 and edge 162 where the top and bottom walls 158 and 160 meet. The general shape of the end cap 153 is in that of an eyelet and conforms to the shape of the end portion 26 of the fixture 100. The end cap 153 has an alignment-receiving slot 118 and a pair of inclined ramp walls 114 similar to those disclosed previously. The end cap 153 has a power receiving slot 170 adapted to receive wire 157 (FIG. 20, the connection not shown to simplify the drawing). Wire 157 is connected to connector 42*a*.

Typically, the hanger 104 is inserted into the end cap 153 in a manner identical to that previously described for fixture 102 relative to fixture 100. The hook members 144 pass through an opening 164 in the top wall 159 of the end cap 153. The end cap may have a plastic insert that is snap fitted into place to provide for the ramping surfaces 114 and the completion of the alignment receiving slot 118. The end cap 153 is assembled to a joiner support 24 in much the same manner as two joiner supports 24 are assembled.

Figure 21:
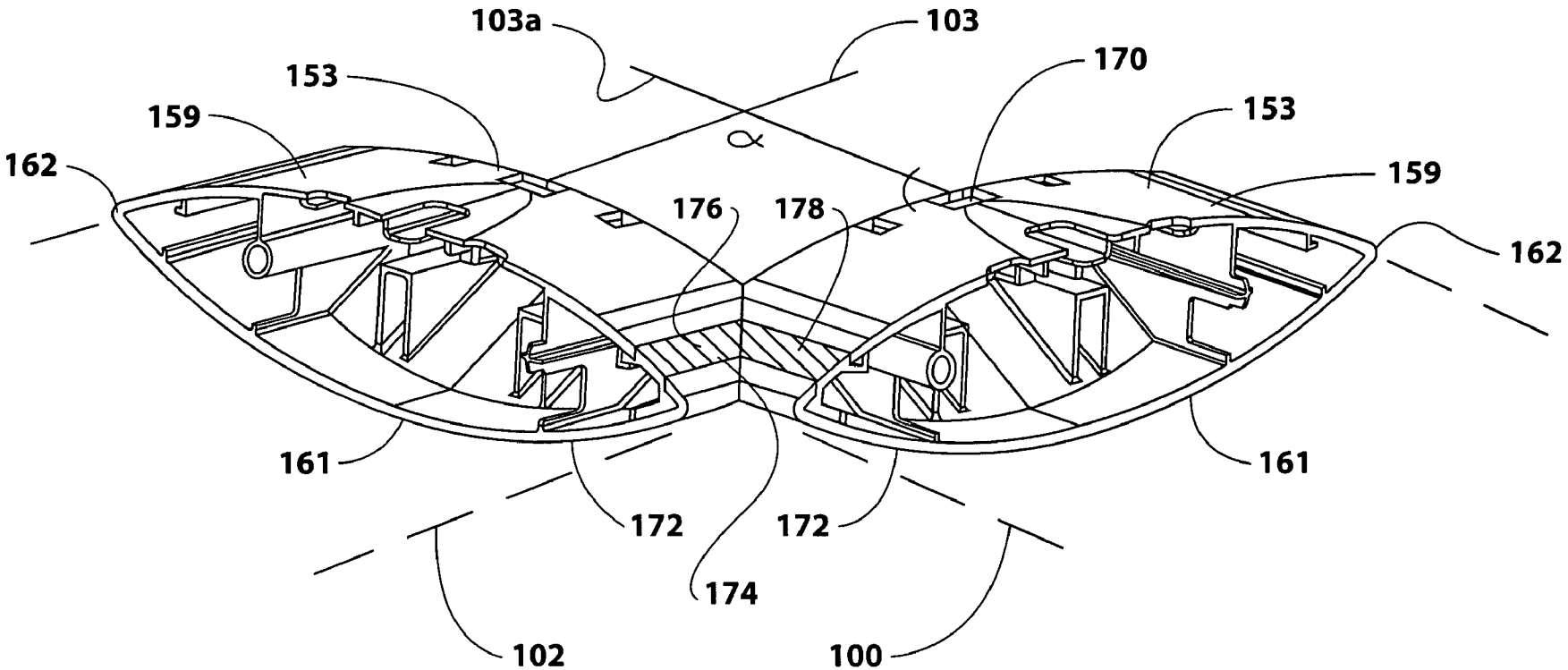
FIG. 21 is a perspective view showing the manner in which end caps are joined for a linear lighting fixture layout.
Figure 22:
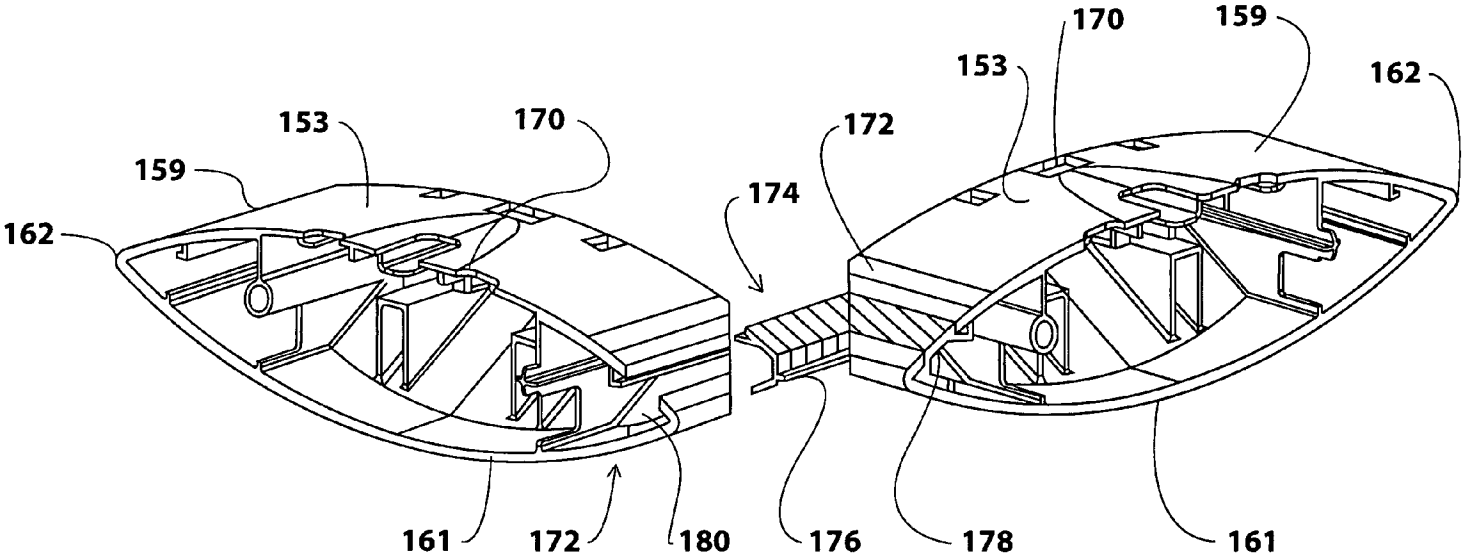
FIG. 22 is a partially exploded view of FIG. 21.
Figure 23:
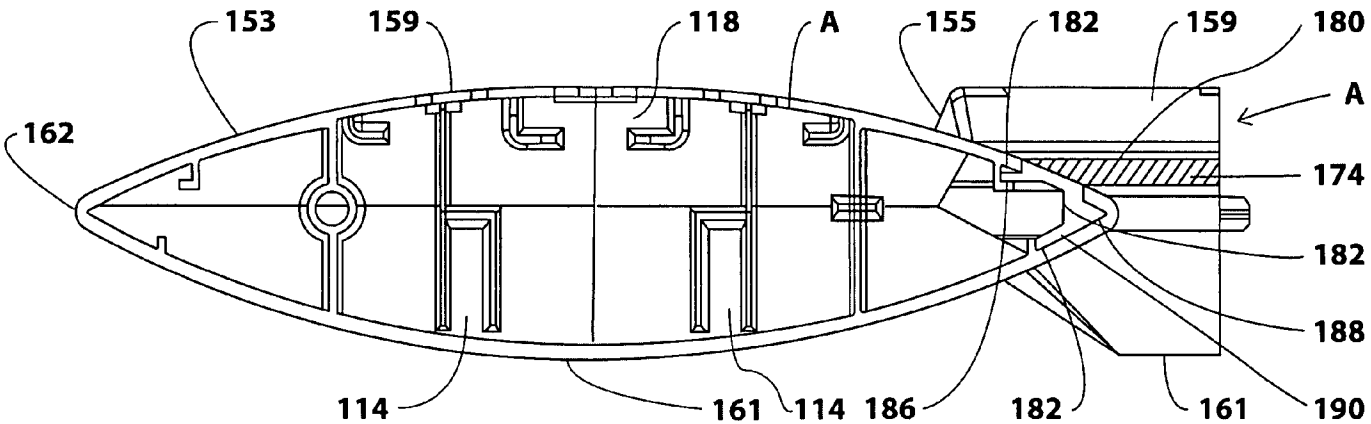
FIG. 23 is a side elevational perspective of FIG. 21.

Referring to FIGS. 21 through 23, there is shown a method of joining end caps 153 in a non-linear fashion. That is to say, the end caps 170 are joined to a fixture in the same manner as shown in FIGS. 17 to 22. These end caps 153, however are for linear lighting fixtures that do not extend along the same longitudinal axis previously referred to as 103.

For the sake of simplicity, the end caps shown in FIGS. 21 and 22 do not show the insert required to complete the first alignment slot in 118 and in the inclined ramps 114, however the insert has been inserted into FIG. 23 and can be seen at 114 and 118. It should be also understood that between the inclined ramp walls 114 is located the electrical plug connector for connection to a corresponding connector located in joiner support 24 of the linear lighting fixture.

The end caps shown in FIGS. 21 through 23 are shown as able to be joined together at an angle of 90°. Each of the end caps 153 has a side 172 connected to an interconnecting member 174. Interconnecting member 174 has spaced or spread apart legs 176 and 178 that are adapted to be mounted to the sides or respective sides 172 of the two end caps 153.

The linear lighting fixtures are shown by ghost lines 100 and 102 to have respective longitudinal axes 103 and 103*a*. These axes are offset by the predetermined angle alpha ($\alpha$) which is 90°. The linear lighting fixtures 100 and 102 comprise the same construction as hereinbefore described.

Each of the sides 172 of the end caps 153 has an open or truncated side, which has a slot 180. Each of the end caps 153 has inner surface walls 182 extending adjacent the slot opening 180. The legs 176 and 178 of the interconnecting member 174 have two elongated flanges 186 and 188 that are co-extensive with and are spaced from the opposing sides 182 of each of the respective legs 176 and 178. These flanges 186 and 188 slide along the inner surface walls 182 to maintain the surface of the leg members 176 and 178 locked in place. The surface of the legs 176 and 178 provide a continuous surface along the side 172 of the end cap 170. In the cross-section shown in FIG. 23, the leg member exemplified by legs 176 of the interconnecting member 174 has a generally U-shaped configuration where each of the arms of the U are represented by the continuing surface or flange 188 and an arm 190 positioned adjacent flange 182 and adapted to engage an inner side wall surface 182 of the end cap 170. It should be noted that this inner side wall surface 182 of the end cap is engaged in sliding relationship by the arm 190 of the leg 176. Further the flange 182 of the leg 176 is located along the inside surfaces 182 between the top and bottom walls of the end cap 153 adjacent or tucked in position at the corner where the top and bottom walls meet.

The interconnecting member 174 co-operating with the slot in the sides 172 of the end cap 153 has the advantage of providing a quick connection between the end cap so that a continuous connection between the end cap and no visual space is seen between the linear lighting fixture which extends along different predetermined axis. Hence the end portions 26 of the linear lighting fixtures 100 and 102 do not abut one another, however the end cap 153 abut adjacent side 172 where the interconnecting member 174 is located. The angle of spread between legs 176 and 178 of interconnecting member 174 is equivalent to the angle α between axis 103 and 103*a*.

It should be understood that the foregoing description with respect to the drawings has been for preferred embodiments of the present invention and that alternate embodiments may be readily apparent to a person skilled in the art.

What is claimed is:

1. A lighting fixture assembly for suspension from an overhead structure, the lighting fixture assembly comprising a plurality of elongate housings, each elongate housing having a top wall, a bottom wall and end portions terminating with outwardly facing peripheral edges, the top wall providing an elongate opening there; a plurality of housing supports, each housing support being mounted within a corresponding housing adjacent a corresponding peripheral edge, a plurality of hanger members, each hanger member supportable by a suspension structure and arranged to engage a first housing support mounted within a first of the elongate housings and a second housing support mounted within a second of the elongate housings, each housing support having housing support portions conforming with and attachable to one or more of the top and bottom walls of the corresponding elongate housing, each housing support having an end portion adapted to abut a respective peripheral edge of the elongate housing thereby limiting placement of the housing support in the elongate housing and to limit leakage of light from the corresponding end of the elongate housing.

2. A lighting fixture assembly of claim 1 wherein the peripheral edge is flat.

3. A lighting fixture assembly of claim 2, wherein the housing supports are adapted for mating slide fit engagement of the corresponding elongate housing.

4. A lighting fixture assembly of claim 1, wherein the elongate housing comprises an extruded aluminum material and the housing supports comprise a one piece plastic material.

5. A lighting fixture assembly of claim 1, wherein each end portion of each housing support includes a peripheral flange with a flush outwardly facing surface enabling adjacent housing supports to abut in a linear fashion.

6. A lighting fixture assembly of claim 5, wherein each housing support includes a raised bridge surface extending across the elongate opening, said raised bridge surface providing a uniform continuum surface across the opening in the top wall and adjacent the opposing end portions.

7. A lighting fixture assembly of claim 5, wherein each housing support has a first socket and an electrical power plug connector seated in the first socket, the electrical power plug connector having an outward facing plug end facing outwardly of the elongate housing for connection with a power source and the electrical power plug connector having an inwardly facing plug end and wires extending from the support into the elongate housing.

8. A lighting fixture assembly of claim 7, wherein each housing support has second socket and a second electrical control connector seated in the second socket, the second control connector having a second plug connector facing outwardly of the elongate housing and control signal wiring extending from the support into the elongate housing.

9. A lighting fixture assembly of claim 1, wherein the bottom and top walls of the elongate housing have a cross-sectional shape in the form of an eyelet with the bottom wall and top wall meeting at corners of the eyelet, and the elongate opening extending along an entire length of the top wall dividing same into two spaced apart housing top wall portions.

10. A lighting fixture assembly of claim 9, wherein the housing supports on opposite sides of each elongate housing include mounting sockets facing inwardly of the elongate housing for supporting fluorescent lamps.

11. A lighting fixture assembly of claim 1, wherein each housing support further comprises ears extending inwardly of the elongate housing adjacent the bottom wall, each of the ears including an opening through to receive a fastener for securing the housing support in the elongate housing.

12. A lighting fixture assembly of claim 1, wherein each housing support further comprises ears that extend inwardly of the elongate housing adjacent the bottom wall, each of the ears includes an opening through which a locking screw passes, two elongate housing side walls extending adjacent the respective top wall portions, the two elongate housing side walls being secured relative to the top and bottom walls by the locking screws passing through the ears of the supports, and the side walls extending a predetermined distance beyond the top wall wherein a bridging surface extends across the elongate opening; riser members mounted to the bridge surface of the each of the first and second supports and extending between the side walls adjacent the end portions of the elongate housing, the riser members each including a second mounting socket facing inwardly of the elongate housing one or more fluorescent lamps mounted to the second mounting sockets to extend between the side walls.

13. A lighting fixture assembly of claim 1, each housing support further comprising an upper surface and an inner surface including a plurality of opposing locking tabs and/or a plurality of spring tab hooks formed on one or more of the upper and inner surfaces.

14. A lighting fixture assembly of claim 13, further comprising a bridge member positioned on the upper and/or inner surfaces and engaged with the opposing locking tabs and/or the spring tab hooks.

* * * * *